US006873312B2

(12) United States Patent
Matsueda

(10) Patent No.: US 6,873,312 B2
(45) **Date of Patent: *Mar. 29, 2005**

(54) LIQUID CRYSTAL DISPLAY APPARATUS, DRIVING METHOD THEREFOR, AND DISPLAY SYSTEM

(75) Inventor: Yojiro Matsueda, Chino (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/142,659

(22) PCT Filed: Jan. 17, 1997

(86) PCT No.: PCT/JP97/00086

§ 371 (c)(1),
(2), (4) Date: Sep. 14, 1998

(65) Prior Publication Data

US 2002/0145602 A1 Oct. 10, 2002

(51) Int. Cl.[7] ..... G09G 3/36
(52) U.S. Cl. ..... 345/98; 345/92; 345/90
(58) Field of Search ..... 345/92, 96, 100, 345/98, 99, 690, 147, 87

(56) References Cited

U.S. PATENT DOCUMENTS 4,667,179 A 5/1987 Law et al.
4,785,297 A * 11/1988 Sekiya ..... 327/202
5,017,914 A * 5/1991 Uchida et al. ..... 345/89
5,384,496 A * 1/1995 Tanaka ..... 327/94
5,400,050 A * 3/1995 Matsumoto et al. ..... 345/100
5,412,397 A * 5/1995 Kanatani et al. ..... 345/99
5,654,733 A * 8/1997 Chimura et al. ..... 345/96
5,731,796 A * 3/1998 Furuhashi et al. ..... 345/96
5,739,804 A * 4/1998 Okumura et al. ..... 345/99
5,739,805 A * 4/1998 Dingwall ..... 345/100
5,748,165 A * 5/1998 Kubota et al. ..... 345/96
5,754,152 A * 5/1998 Nakamura et al. ..... 345/94
5,764,216 A * 6/1998 Tanaka et al. ..... 345/147
5,818,406 A * 10/1998 Tsuchi et al. ..... 345/89
6,078,368 A * 6/2000 Ichikawa et al. ..... 349/48
6,191,768 B1 * 2/2001 Imamura ..... 345/98

FOREIGN PATENT DOCUMENTS

JP 61-256824 A 11/1986

(Continued)

*Primary Examiner*—Amr Awad
*Assistant Examiner*—Alecia D. Nelson
(74) *Attorney, Agent, or Firm*—Oliff & Berridge, PLC

(57) ABSTRACT

An n-bit digital image data is converted to (n+m)-bit data with a g-correction table, and displayed by the use of a (n+m)-bit D/A converter. A peripheral-driver logic section is driven with a low-voltage common power source and countermeasures to noise are taken. Data input to the D/A converter is not reversed and the power to the D/A converter is made alternating to apply an AC voltage to aligned crystal layer. A circuit is provided in order to compensate for a delay time in the driver. With this configuration, the image quality of a liquid crystal display apparatus in which the D/A converter is built is improved.

10 Claims, 22 Drawing Sheets

FOREIGN PATENT DOCUMENTS

| | | | |
|---|---|---|---|
| JP | A-62-10696 | | 1/1987 |
| JP | 62-245724 | A | 10/1987 |
| JP | U-63-82228 | | 5/1988 |
| JP | 02-271390 | | 11/1990 |
| JP | A-3-35218 | | 2/1991 |
| JP | 3-35218 | | 2/1991 |
| JP | A-3-89393 | | 4/1991 |
| JP | A-4-11282 | | 1/1992 |
| JP | A-4-502520 | | 5/1992 |
| JP | A-4-268818 | | 9/1992 |
| JP | 5-136696 | A | 6/1993 |
| JP | 05-281920 | | 10/1993 |
| JP | A-5-281920 | | 10/1993 |
| JP | A-6-95619 | | 4/1994 |
| JP | A-6-152424 | | 5/1994 |
| JP | A-6-222741 | | 8/1994 |
| JP | 06-301007 | | 10/1994 |
| JP | 59-189724 | | 10/1994 |
| JP | 6-324646 | | 11/1994 |
| JP | 8-146919 | A | 6/1996 |
| JP | A-8-237125 | | 9/1996 |

* cited by examiner

LIQUID CRYSTAL DISPLAY APPARATUS, DRIVING METHOD THEREFOR, AND DISPLAY SYSTEM

BACKGROUND OF THE INVENTION

1. Field of the Invention

The present invention relates to a liquid crystal display apparatus, a driving method therefor, and a display system.

2. Background of the Invention

A conventional liquid crystal display apparatus is, for example, disclosed in the Japanese Unexamined Patent Publication No. 6-222741. FIG. 2 is a circuit diagram of a data driver in the liquid crystal display apparatus. Data driver systems for writing an image signal into a liquid crystal display apparatus generally includes an analog system and a digital system. Since the analog system consumes a large power in the circuit, it is not suited to a display for a portable computer. In contrast, the digital system consumes a small power, but it requires that an output voltage be supplied from the outside and the number of external power sources becomes large. There is a system in which a D/A converter is built and the number of external power sources is made minimum. Since the output voltage of a D/A converter is linear in general and its linearity differs from the g characteristic of liquid crystal, this system is not suited to gray-scale display. Therefore, the difference between input voltages is interpolated and output to conduct g correction to some extent while the number of external power sources is reduced.

In the circuit shown in FIG. 2, for example, nine levels of voltages are externally supplied and a total of 64-level output voltages can be output. V1, V2, . . . and V9 are externally given nine power source voltages. The three high-order bits 21 of an image signal are converted to eight-value data in a decoder 23. Power selection circuits 24 and 25 select two adjacent power sources from these nine power source voltages. The three low-order bits 22 of the image signal are converted into eight-value data. A resistor-division-type D/A converter 26 selects and outputs one voltage from equally divided eight voltages between the two selected voltage levels. In this system, when the nine power source voltages input externally are made optimum according to the g characteristic of the liquid crystal, g correction can be achieved to some extent.

A conventional TFT circuit, however, has the following drawback. An interpolated and output voltage differs from the voltage to be ideally displayed. This point will be described below by referring to the drawings. FIG. 3 is chart indicating the relationship between the applied voltage and the transmission ratio of the liquid crystal display apparatus. An actual liquid crystal display apparatus has a transmission-factor dependency indicated by a dotted curve 31. Since the data driver circuit shown in FIG. 2 uses the nine input power source voltages, V1, V2, . . . , and V9, to interpolate the output voltages, a transmission ratio dependency shown by a broken line 32 is assumed. FIG. 4 is a partially enlarged view of FIG. 3. When the difference between two input voltages V1 and V2 is equally divided into eight sections and the output voltages, Va, Vb, Vc, Vd, Ve, Vf, and Vg, are applied to the liquid crystal display apparatus, the corresponding gray scale is displayed with Ta, Tb, Tc, Td, Te, Tf, and Tg, and shows white compression.

SUMMARY OF THE INVENTION

A liquid crystal display apparatus, a driving method therefor, and a display system according to the present invention are made to solve the foregoing drawback, and their object is to provide a high-image-quality liquid crystal display apparatus.

A liquid crystal display apparatus according to the present invention is characterized by comprising a data conversion circuit for converting n-bit digital input image data to (n+m)-bit data, and an (n+m)-bit digital data driver. A driving method for a liquid crystal display apparatus according to the present invention is characterized in that an n-bit digital input signal is sequentially converted to (n+m)-bit digital data according to the g characteristic of the liquid crystal and is displayed in n-bit gray scale with the use of an (n+m)-bit digital data driver.

A liquid crystal display apparatus according to the present invention is characterized in that a data driver for driving a signal line includes a CMOS static shift register, a level shifter, and a D/A converter; a scanning driver for driving a scanning line includes a CMOS static shift register, a level shifter, and a buffer; the shift register in the data driver, the shift register in the scanning driver, and the input image signal input section of the D/A converter are connected to a common power source; and the voltage of the common power source is lower than the power source voltage of the D/A converter and the buffer circuit. A driving method for a liquid crystal display apparatus according to the present invention is characterized in that a data driver includes a D/A converter; an image signal input to the D/A converter and the timing signal of a shift register have the same amplitude; and the power source level of the D/A converter is alternately switched in every field to apply an AC voltage to the liquid crystal. Alternatively, the driving method may be characterized in that the data driver includes D/A converters in a plurality of systems; the power source level of the D/A converters is alternately switched in every horizontal scanning period to apply an AC voltage to the liquid crystal; and image signals having reverse polarities are always applied to adjacent signal lines. Alternatively, the driving method may be characterized in that the data driver includes D/A converters in a plurality of systems; the power source level of the D/A converters is alternately switched in every horizontal scanning period to apply an AC voltage to the liquid crystal; and image signals having reverse polarities are always applied to adjacent signal lines. Alternatively, the driving method may be characterized in that the power source level of the D/A converter is alternately switched in every field; and the voltage of the common electrode is alternately switched in every field to apply an AC voltage to the liquid crystal. Alternatively, the driving method may be characterized in that the power source level of the D/A converter is alternately switched in every horizontal scanning period; and the voltage of the common electrode is alternately switched in every horizontal scanning period to apply an AC voltage to the liquid crystal. Alternatively, the driving method may be characterized in that the power source level of the D/A converter is alternately switched in every field; a scanning signal has four voltage levels; and a case in which the scanning signal holds a non-selection voltage or more for a certain period before it changes from a selection voltage to the non-selection voltage immediately after the selection period, and a case in which the scanning signal holds the non-selection voltage or less in the same situation are switched in every field to apply an AC voltage to the liquid crystal. Alternatively, the driving method may be characterized in that the power source level of the D/A converter is alternately switched in every horizontal scanning period; a scanning signal has four voltage levels; and a case in which the scanning signal holds a non-selection voltage or more for a certain period before it changes from a selection voltage to the non-selection voltage immediately after the selection period, and a case in which the scanning signal holds the non-selection voltage or less in the same situation are switched in every horizontal scanning period to apply an AC voltage to the liquid crystal.

A liquid crystal display apparatus according to the present invention is characterized in that a data driver includes a shift register and a latch; and a delay circuit for delaying the timing of image signal data according to a delay time in the shift register is provided. A driving method for a liquid crystal display apparatus according to the present invention is characterized in that the timing of image signal data is delayed according to a delay time from a clock signal for a shift register to an output signal for controlling latch.

A display system according to the present invention is characterized by comprising an A/D converter for converting an analog image signal to n-bit digital data; a g-correction circuit for converting the n-bit image signal data to (n+m)-bit data according to the g characteristic of the liquid crystal; a data driver having a (n+m)-bit D/A converter; and a timing controller for controlling the operation timing of these circuits.

These and other aspects and salient features of the invention will be described in or apparent from the following detailed description of preferred embodiments.

DETAILED DESCRIPTION OF PREFERRED EMBODIMENTS

According to the drawings, embodiments of the present invention will be described below.

(Embodiment 1)

Figure 1:
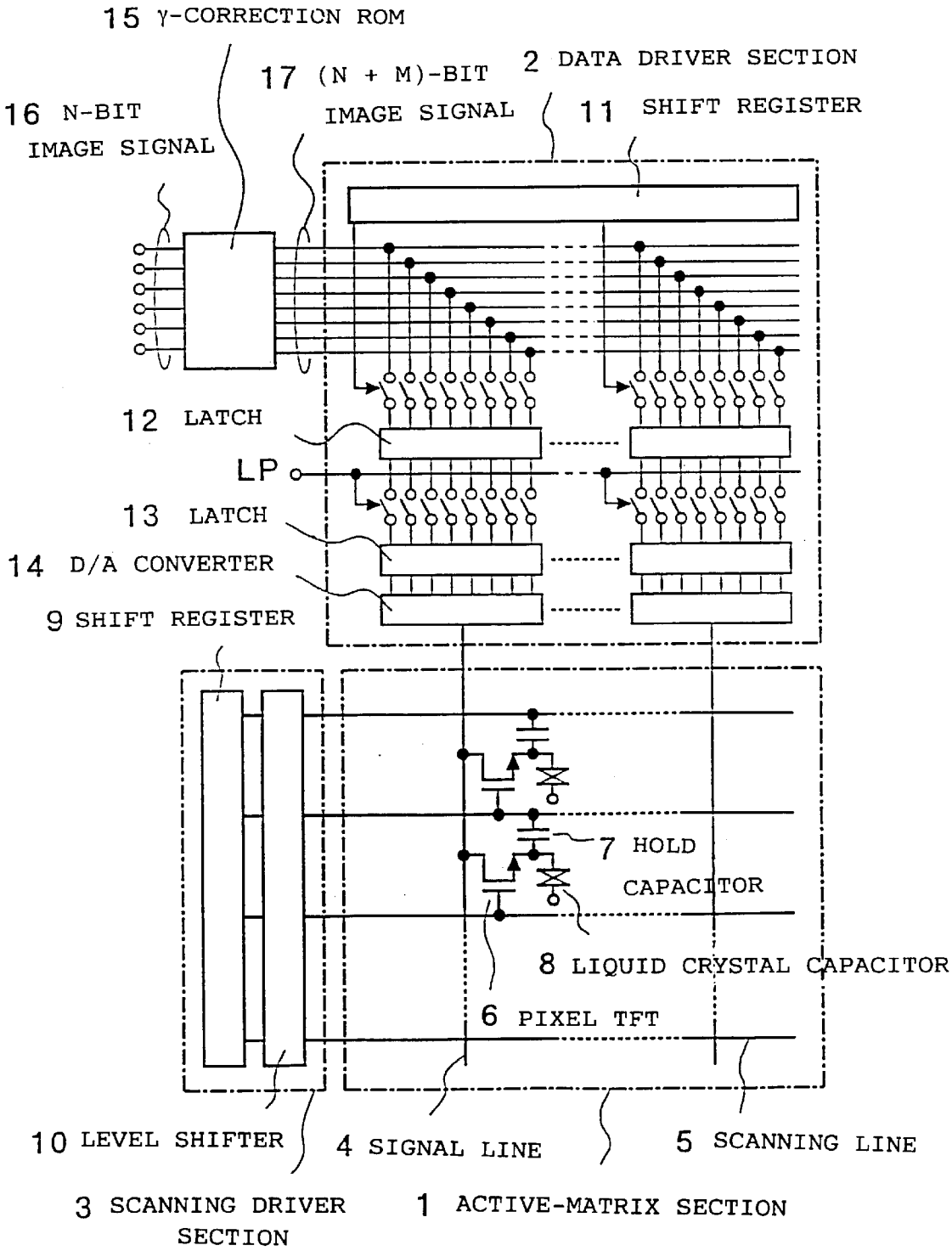
FIG. 1 is a circuit diagram of a liquid crystal display apparatus.
Figure 2:
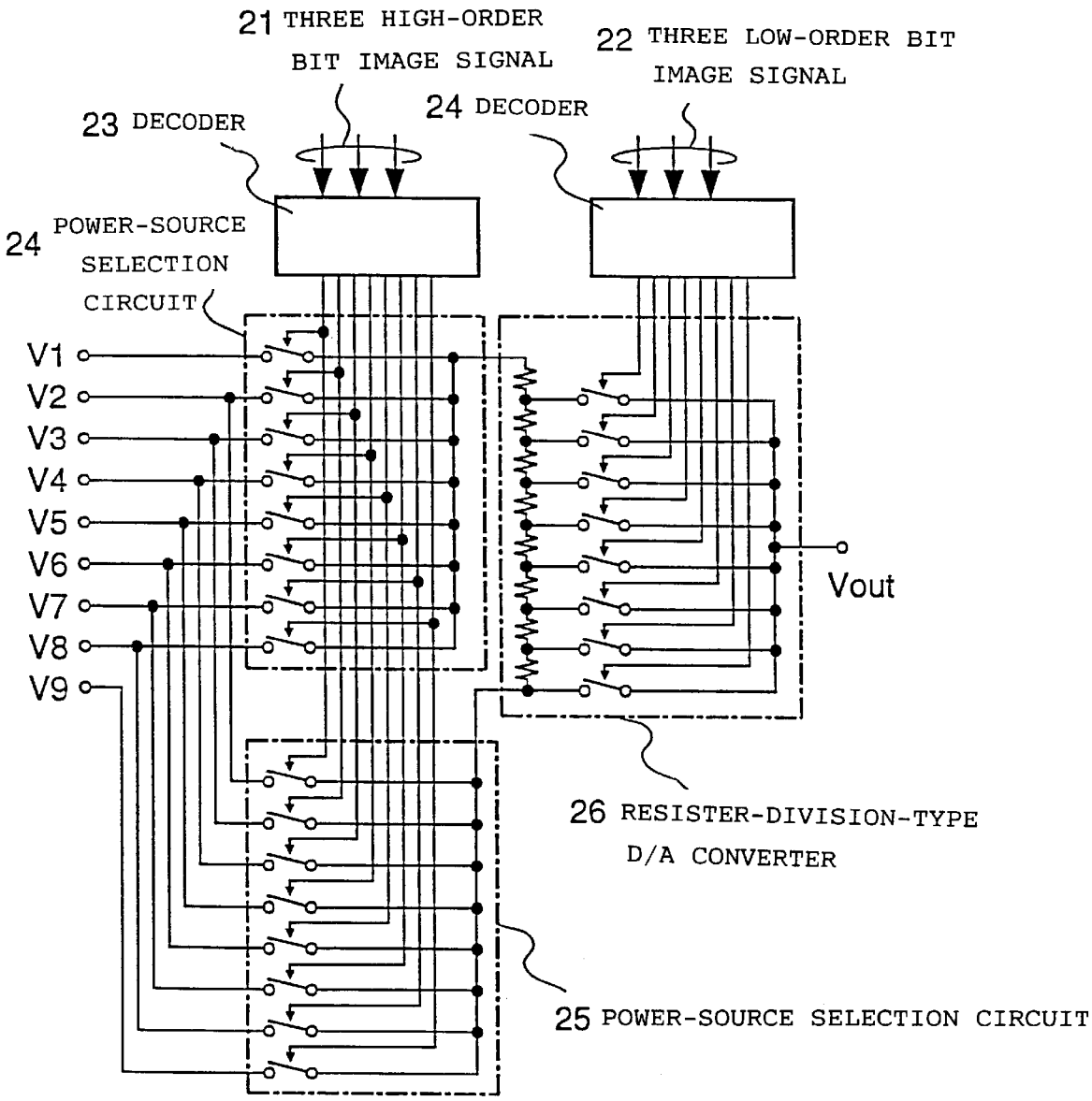
FIG. 2 is a circuit diagram of a conventional data driver in which a D/A converter is built.
Figure 3:
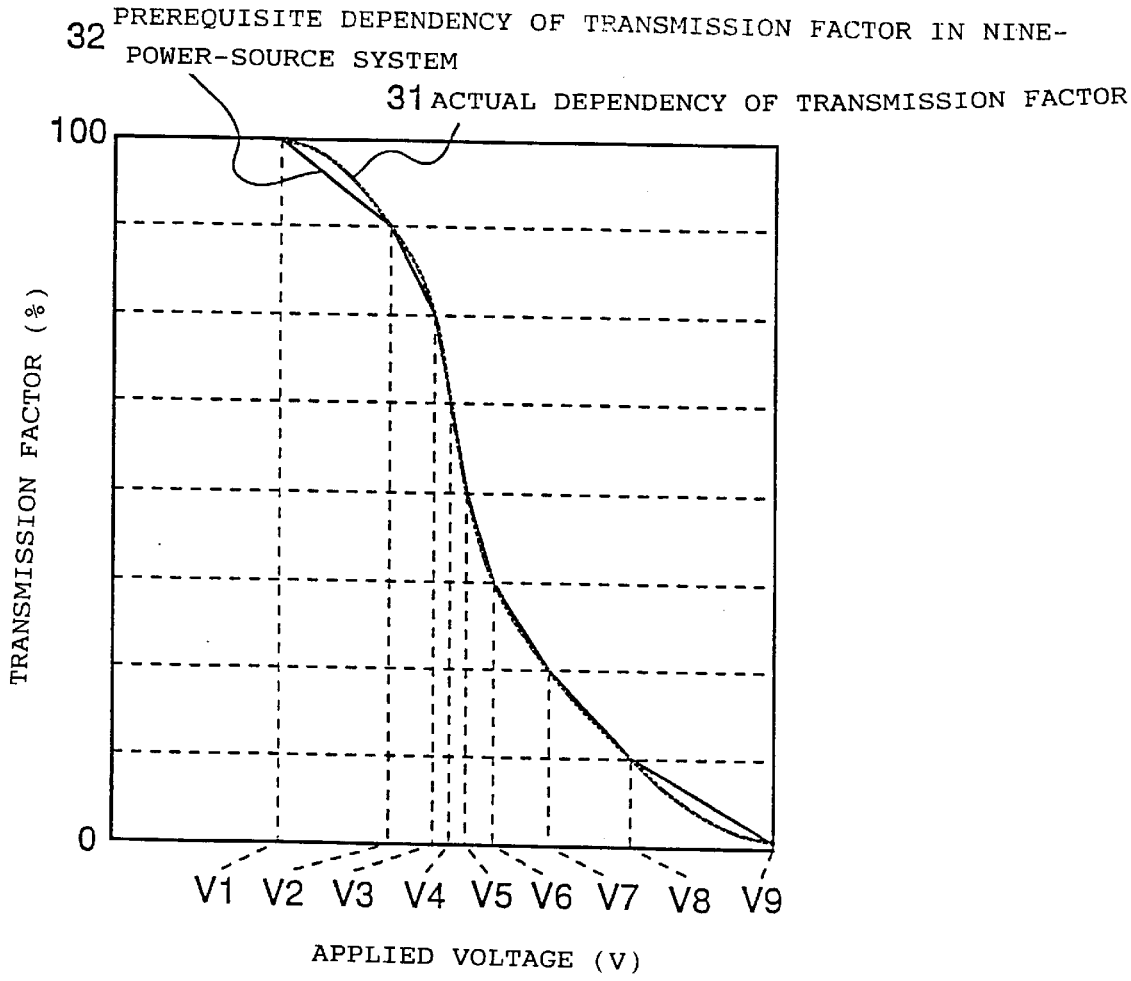
FIG. 3 is a chart showing the dependency of the transmission ratio on the input voltage in a nine-power-source-type liquid crystal display apparatus.
Figure 4:
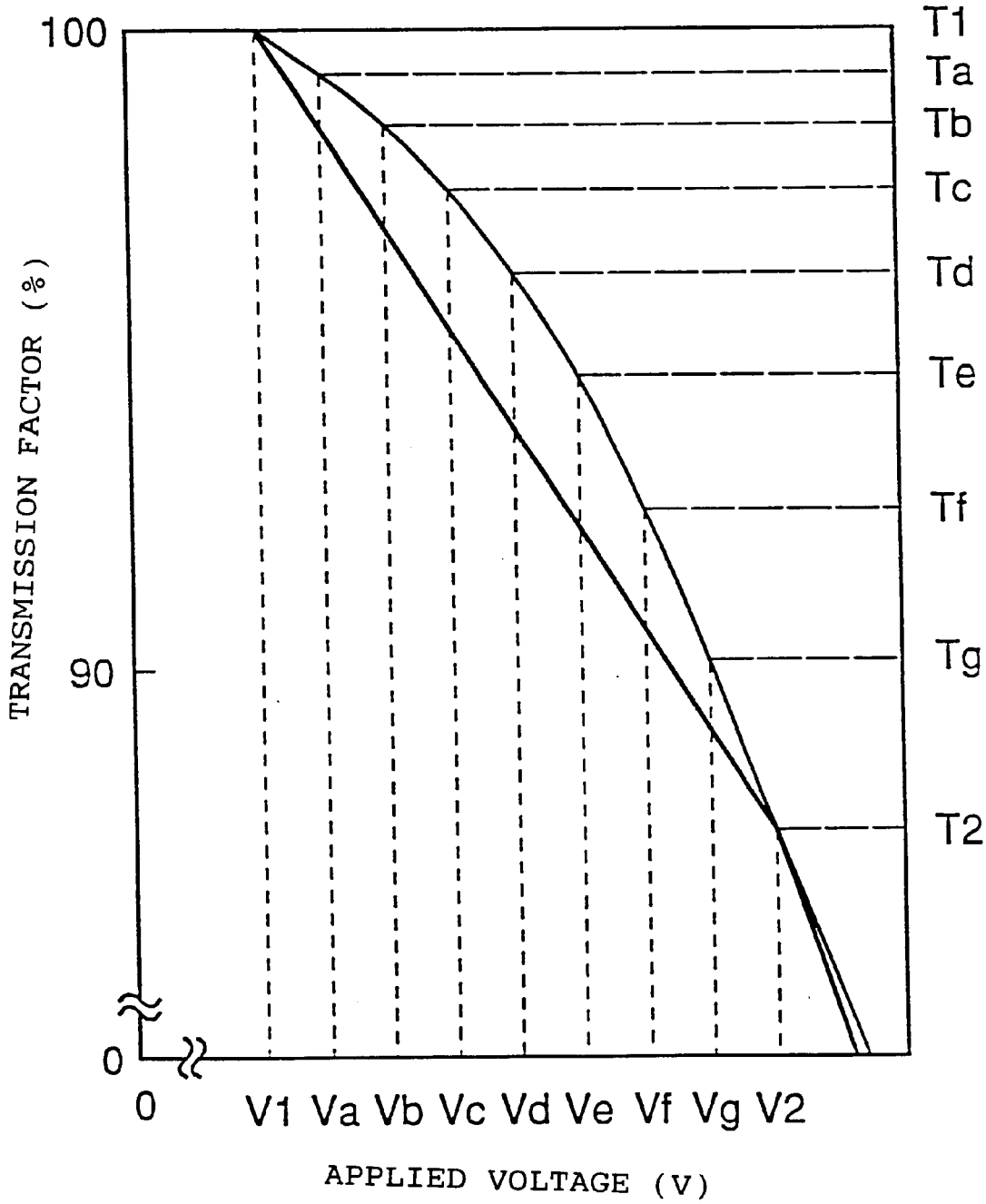
FIG. 4 is a chart showing a part of the dependency of the transmission ratio on the input voltage in the nine-power-source-type liquid crystal display apparatus.

A liquid crystal display apparatus according to the present embodiment will be described below by referring to the drawings. FIG. 1 is a circuit diagram of a liquid crystal display apparatus. The liquid crystal display apparatus having thin-film transistors (TFTs) will be described. In an active matrix section 1 for conducting image display, signal lines 4 and scanning lines 5 are disposed in a matrix manner, and at an intersection thereof a pixel TFT 6, a hold capacitor 7, and a liquid crystal capacitor 8 are connected. A scanning driver section 3 for supplying a selection pulse to scanning lines 4 is formed by a shift register 9 and a level shifter 10. The level shifter 10 is provided with a buffer circuit at its output section in many cases. A data driver section 2 for sending an image signal to signal lines 4 is formed by a shift register 11, latches 12 for reading data from a (n+m)-bit digital image signal 17 according to the output timing of the shift register 11, latches 13 for writing the data stored in the latches 12 at a batch, and a D/A converter 14 for converting the (n+m)-bit digital image data stored in the latches 13 to an analog signal. With these two-stage latches, since, while data is rewritten into the first-stage latch 12, the D/A converter operates with the data stored in the latches 13, a sufficient time can be assured for driving the signal lines 4.

N-bit digital image signal data 16 is converted to (n+m)-bit digital image signal data in a data conversion circuit. A g correction ROM 15 serves as the data conversion circuit. With the g characteristic of the liquid crystal being actually measured, when the ROM address is connected to the n bits of an input image signal and the (n+m)-bit output data is set so as to provide the desired g characteristic, data can be sequentially converted easily. When a different liquid crystal material is used, for example, this ROM needs to be just changed to the suited one. Of course, other circuits may be used for data conversion. It is preferred that ROM having a g correction table should be used.

The digital data driver having the D/A converter is used in the embodiment. A full-digital driver or a PWM-output driver may be used. Since g correction is conducted by converting image data from n bits to (n+m) bits in the embodiment, the output after data conversion may be linear. If an linear output can be used, it is preferred that the D/A converter built-in system should be employed which has the small number of input power sources and relatively simple circuit configuration, and can handle various sizes of screens.

In the present embodiment, the active-matrix-type liquid crystal display apparatus is described, but the present invention can be applied to all liquid crystal apparatuses including the simple matrix type. Since the number of scanning lines increases and the voltage ratio of a selected section to a non-selection section decreases in a simple-matrix-type apparatus, it is theoretically difficult to display multiple tones. Therefore, to achieve high image quality with multiple tones, it is preferred that an active-matrix-type liquid crystal display apparatus be used.

Figure 5:
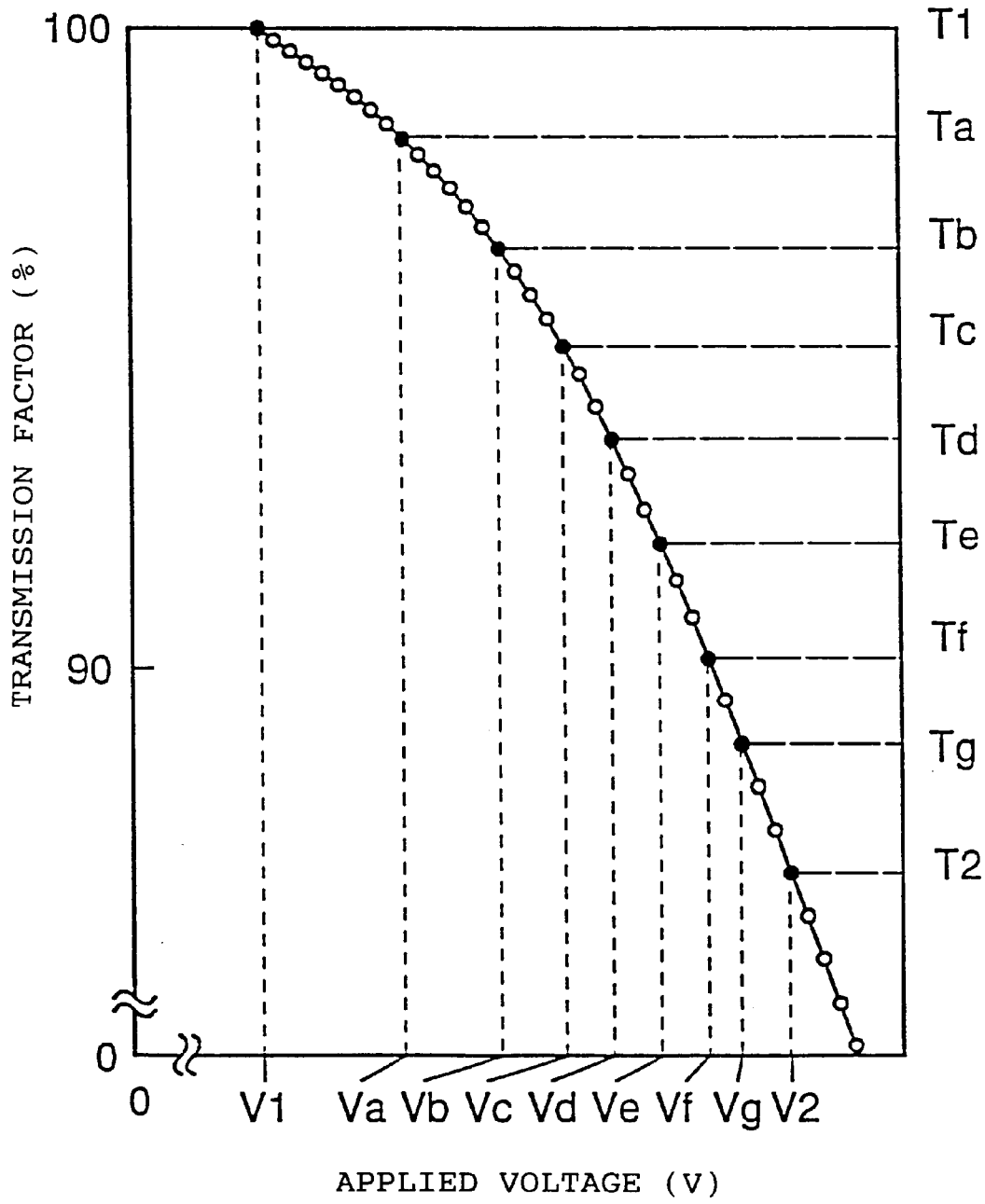
FIG. 5 is a chart showing a part of the dependency of the transmission ratio on the input voltage in a liquid crystal display apparatus.

The g correction in the present invention will be described by referring to FIG. 5. A case is assumed in which six-bit digital image signal data is converted to eight-bit digital image signal data according to a g-correction table. In FIG. 5, white circles indicate voltages which can be output by an eight-bit D/A converter and the transmission ratios of a liquid crystal display apparatus corresponding to the voltages, and black circles indicate six-bit data selected from the eight-bit data which is converted from six-bit data according to the g-correction table, the corresponding output voltages, and the transmission ratios therefor of the liquid crystal display apparatus.

When six-bit data is converted to eight-bit data, one conversion data item is generally selected from four possible conversion data items for all of the eight-bit data. The selected voltage difference is changed in the conversion according to the dependency of the transmission ratio on the applied voltage in the liquid crystal display apparatus. For example, in a zone having a steep dependency of the transmission ratio on the applied voltage of the liquid crystal display apparatus, one conversion data item is selected from three possible data items or one conversion data item is selected from two possible data items, and in a zone having a gentle dependency one conversion data item is selected from five possible data items. As a result, transmission ratios for gray-scale display can be obtained with an almost equal ratio difference as indicated by Ta, Tb, Tc, . . . , and Tg. Of course, the transmission ratios can be arranged in geometric progression and can be set to show the desired g characteristic, as required. Gray-scale display can be conducted with a slightly brighter point than the intermediate brightness being disposed at the center in order to focus on the brightness of the screen. If a plurality of g-correction table ROMs is provided, the transmission ratios can be switched between different g characteristics according to use purposes and used for display.

In this embodiment, g correction is performed with two bits being added. The more the number of additional bits is increased, such as three bits or four bits, the more precisely the g correction is performed. If the number of additionally added bits is increased too many, however, the D/A converter circuit becomes complicated. Therefore, it is practically preferred that two or three bits should be added. A frame rate control method can also be used to increase the number of bits used for gray-scale display. Frame rate control of two bits is added to a driver in which a six-bit D/A converter is built to enable gray-scale display with eight-bit linear voltages. Then, six-bit display is allowed with the use of a g-correction table as described above.

In FIG. 1, the active matrix section, the scanning driver section, and the data driver section are separated from each other. This is because external LSI chips are usually used for the driver circuits and mounted on an active-matrix-type liquid crystal panel in many cases. To make the apparatus compact and inexpensive, it is required that these driver circuits should be formed on an active-matrix substrate as a unit by the use of TFTs. A poly-silicon TFT circuit formed on a glass substrate can be employed for achieving this configuration. A method for forming the poly-silicon TFT circuit will be described below.

FIG. 16 is a cross section of a poly-silicon TFT in each process in a case in which the driver sections are formed by CMOS self-alignment TFT circuits and the active matrix section is formed by a LDD-type TFT circuit. As shown in FIG. 16(*a*), an insulating film is deposited on a glass substrate for preventing impurities from spreading from the substrate, and a poly-silicon thin film 72 is deposited. To increase field-effect mobility, it is required to improve the crystallinity of the poly-silicon thin film 72. Therefore, the poly-silicon thin film is recrystallized with the use of laser annealing or the solid-phase growth method, or an amorphous silicon thin film is crystallized to form a poly-silicon film. This poly-silicon thin film 72 is patterned in an island shape, and a gate insulating film 73 is deposited thereon. As shown in FIG. 16(*b*), a gate electrode 74 is formed, a portion made to be an n-channel TFT is covered by a mask member 75, and the portion is doped with a boron ion at high concentration to form the source and the drain of a p-channel TFT. Next, as shown in FIG. 16(*c*), the mask member is removed, and the entire area is doped with an phosphorous ion at low concentration. Then, as shown in FIG. 16(*d*), a portion made to be the p-channel TFT and the LDD section of a pixel TFT are covered by mask members, and the entire area is doped with phosphorous ion at high concentration. In the pixel TFT, the LDD area made from n-type high-resistance poly-silicon thin film ($n^-$poly-Si) is formed between a channel section and the source and drain electrodes made from n-type low-resistance poly-silicon thin film ($n^+$poly-Si) in this way. With this configuration, the off current of the pixel TFT can be suppressed to a sufficiently low level, and crosstalk can be prevented from being generated in the active matrix section. Lastly, as shown in FIG. 16(*e*), an interlayer insulating film 76 is formed, a wiring 77 is formed by a metal thin film, a pixel electrode is made from a transparent electrically conductive film 79, and a passivation film 78 is formed to complete the active matrix substrate with the driver formed together. Alignment is applied to the substrate, another substrate to which alignment is also applied is disposed oppositely with a gap of several $\mu$m, and liquid crystal is sealed in the active matrix section to complete the liquid crystal display apparatus.

Figure 6:
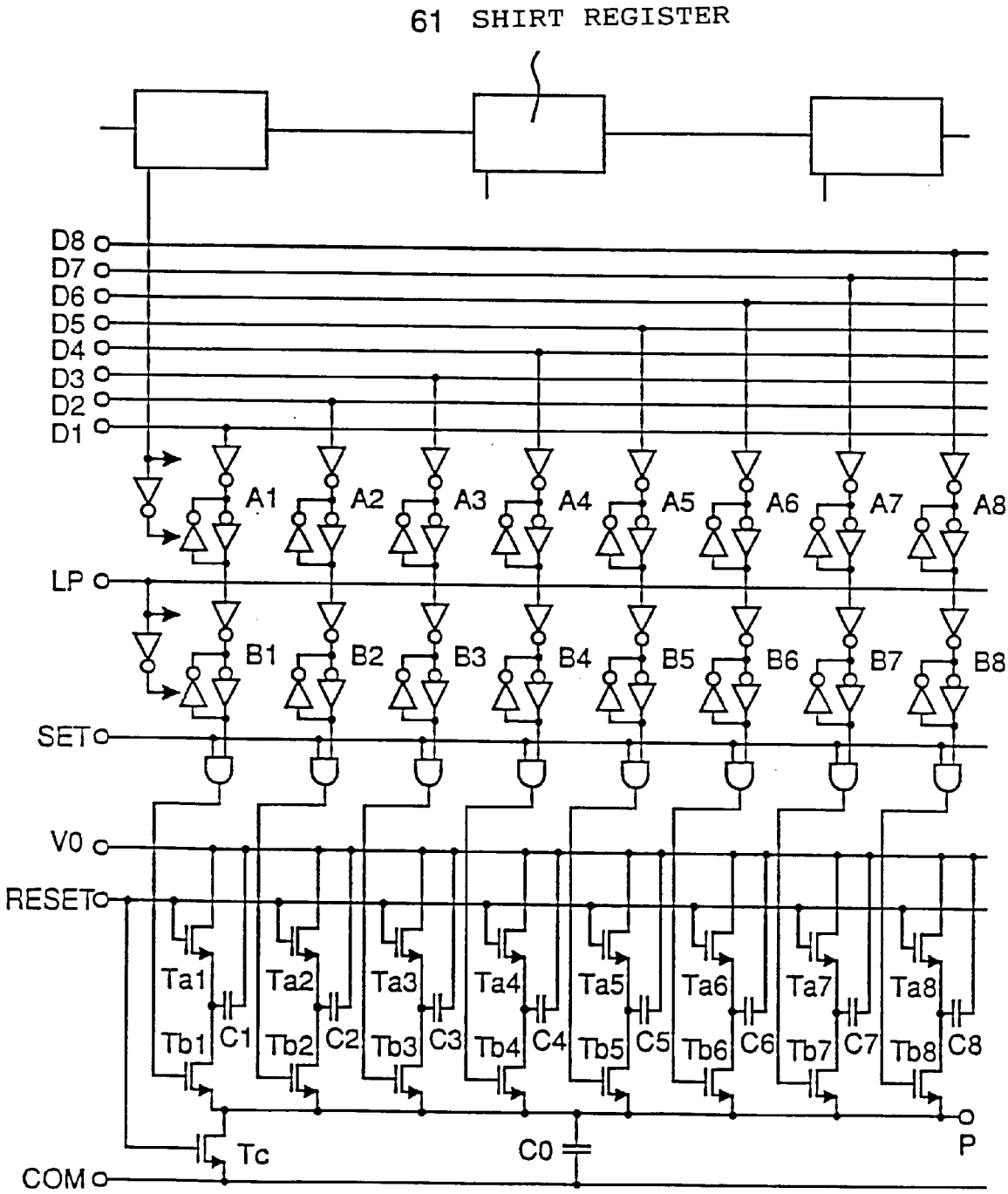
FIG. 6 is a circuit diagram of a data driver in which a capacitor-division-type D/A converter is built.

A configuration of the D/A converter will be described below specifically. FIG. 6 is a circuit diagram of an eight-bit data driver which uses a capacitor-division-type D/A converter. A shift register 61 outputs a timing pulse for latching one signal line data to each stage. With this output, eight digital latches A1, A2, A3, . . . , and A8 read eight-bit data from data lines D1, D2, D3, . . . , and D8 at the same time. A latch pulse terminal LP controls second-stage latches B1, B2, B3, . . . , and B8. A set terminal SET controls a timing at which data is sent to the D/A converter. A reset terminal RESET resets the data of the D/A converter. There is also shown a common power source V0 for the D/A converter and a power source COM for resetting the voltage of a signal line. C0 indicates the equivalent capacitor of one signal line, and point P corresponds to a signal line.

The eight-bit D/A converter is formed by eight capacitors C1, C2, C3, . . . , and C8, eight reset transistors Ta1, Ta2, Ta3, . . . , and Ta8, and eight set transistors Tb1, Tb2, Tb3, . . . , and Tb8. A transistor Tc resets the voltage of the signal line. The capacitances of the eight capacitors C1, C2, C3, . . . , and C8 are set to have a ratio of 1:2:4:8:16:32:64:128. When the same voltage is applied to these capacitors after their charges are reset, the charges stored in the capacitors have this ratio. Since the capacitance of the signal line is constant, when any of these eight capacitors is connected to the signal line by making the corresponding switch, the corresponding voltage, which is one of 256 combinations, is applied to the signal line.

Although it is difficult in this method to apply nonlinear gray-scale voltages, since g correction is achieved while n-bit data is converted to (n+m)-bit data as described above, a data driver using this D/A converter shows good gray-scale display characteristics. Since the power consumption of the D/A converter is very small and the circuit is very simple in this method, this D/A converter is best suited to a portable display unit. To perform highly precise D/A conversion with this method, it is required that the capacitance ratio be accurate. When these capacitors are formed by a semiconductor technology and thin-film technology, however, even if a pattern dimension is slightly shifted, the largest capacitance may have an error corresponding to the smallest capacitance. Therefore, it is preferred that a capacitor pattern having the same shape should be connected in parallel by the number of required capacitors. For example, a capacitor having the same pattern, two capacitors having the same patterns, four capacitors having the same patterns, . . . , or 128 capacitors having the same patterns, are connected in parallel. In this method, if a pattern is made slightly larger or slightly smaller, the capacitance ratio is maintained.

Figure 8:
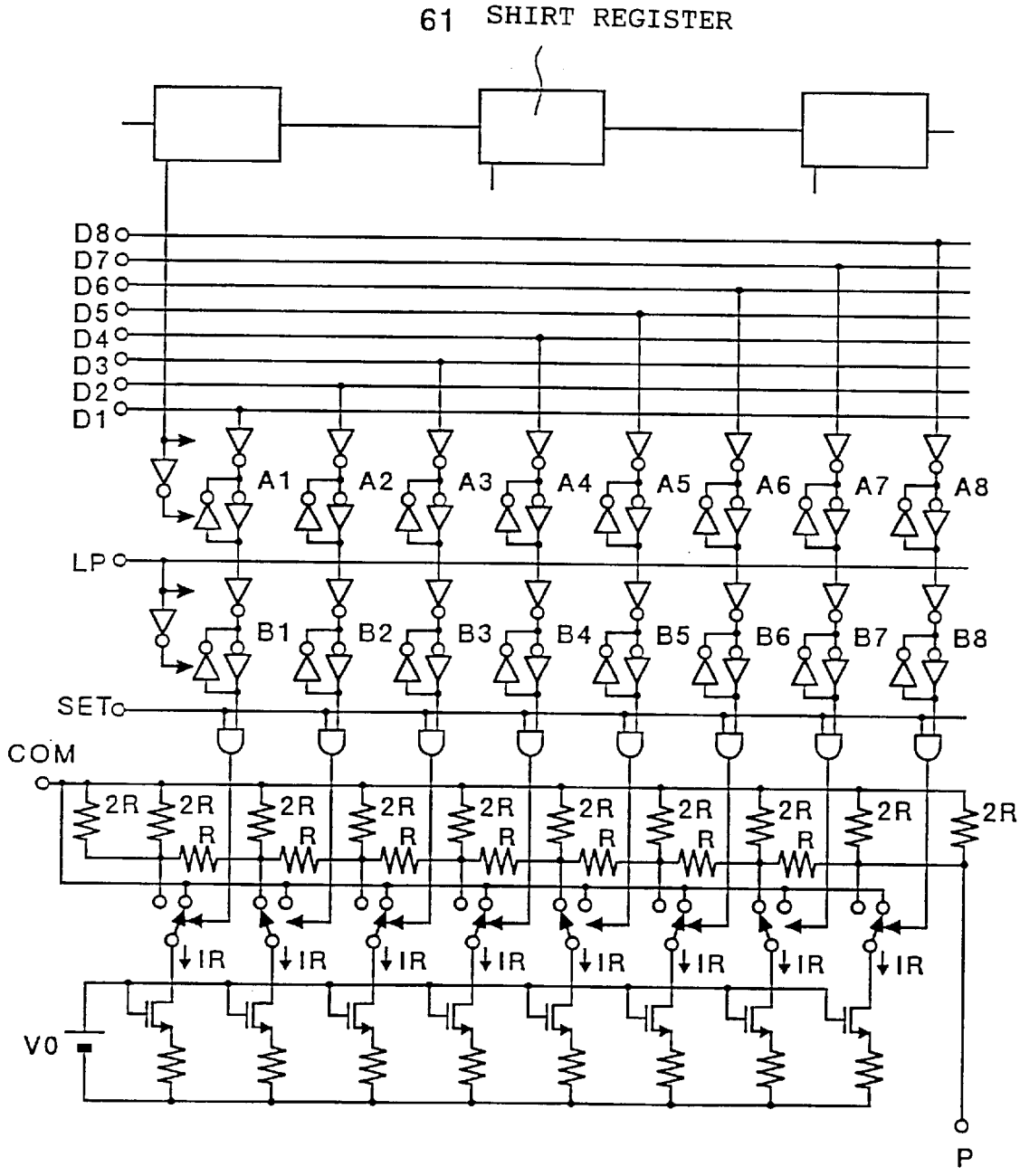
FIG. 8 is a circuit diagram of a data driver in which a constant-current binary attenuation-type D/A converter is built.

A case in which an another-method D/A converter is used will be described below. FIG. 8 is a data driver using an eight-bit D/A converter which employs the constant-current binary attenuation method. Eight constant-current power sources and eight resister circuit networks having R and 2R are combined. Since a constant current IR flows through each constant-current circuit, the same transistor can be used to form the circuit. Due to having constant-current power sources, this D/A converter does not receive much limitations on the size of a capacitor of a signal line serving as a load. Therefore, any screens from a relatively small screen to a large screen can be handled. If current supply ability is set too high, power consumption is increased.

Two types of D/A converters have been described. The present invention can be applied to a data driver using any type of a D/A converter, and different-type D/A converters can be combined and used. In the above description, an n-bit image signal is taken as an example. It is needless to say that when three primary color signals are input at the same time, (3×n)-bit data is converted to (3×(n+m))-bit data. To reduce the operating frequency of the data driver, when the screen is divided into p sections and (p×n)-bit data is input at the same time, it is required that (p×n)-bit data should be converted to (p×(n+m))-bit data. As described above, the liquid crystal display apparatus according to the present invention can achieve satisfactory g correction for various types of input digital signals.

(Embodiment 2)

In the present embodiment, a driving method for a liquid crystal display apparatus will be described. In FIG. 1, the n-bit image signal 16 is converted to the (n+m)-bit image signal 17 by the sequential-g-correction ROM 15 and is input to the data driver section 2. How to create a g-correction table to be stored in the g-correction ROM will be described below. The transmission ratio of the liquid crystal display apparatus is measured, and a chart indicating the dependency of the transmission ratio on the input voltage is made with the transmission ratio being assigned to the vertical axis and the input voltage being assigned to the horizontal axis. Then, on the horizontal axis indicating the input voltage, $2^{n+m}$ voltages which can be output from the (n+m)-bit D/A converter are plotted. The transmission ratios which are to be obtained for n-bit gray-scale display are plotted on the vertical axis, horizontal parallel lines are drawn from those points to the transmission-factor curve, and perpendiculars from the intersections to the horizontal axis are drawn. The converted data is obtained by (n+m)-bit points closest to the intersections of the perpendiculars and the horizontal axis. The points indicated by black circles in FIG. 5 are obtained by this method. When the ROM address corresponds to n-bit data and the (n+m)-bit data obtained by the above method is stored, sequential conversion is easily implemented with one ROM.

Figure 7:
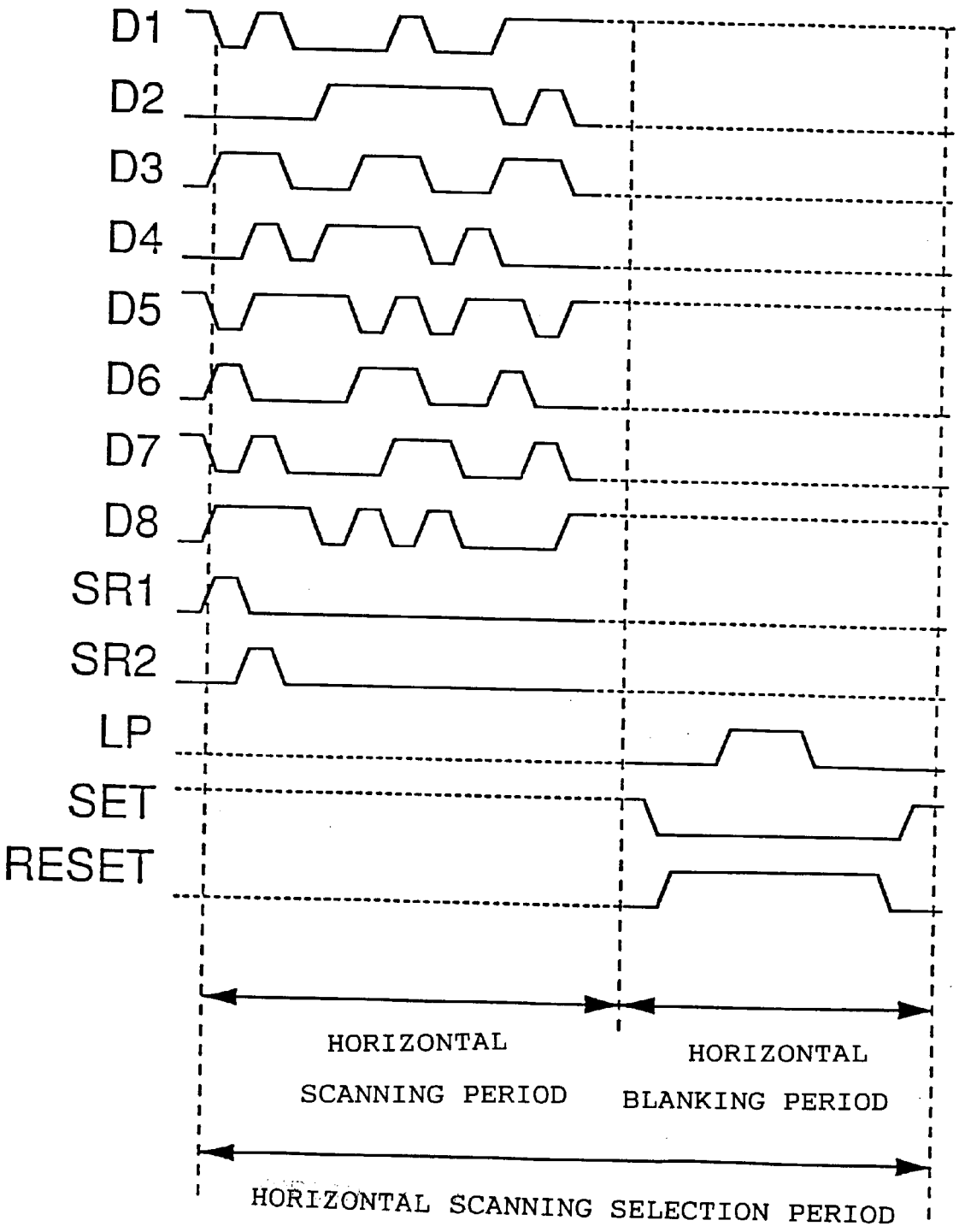
FIG. 7 is a timing chart indicating operation voltages of an eight-bit data driver.

A method for driving the liquid crystal display apparatus by the use of image signals converted by such a sequential g-correction table will be described next. FIG. 7 is a timing chart of the driving voltages of an eight-bit digital data driver similar to that shown in FIG. 6. One horizontal scanning period is divided into a horizontal scanning selection period in which image signal data is sent and a horizontal blanking period in which image signal data is not sent. In the horizontal scanning selection period, eight-bit image signal data, D1, D2, D3, . . . , and D8 is sequentially sent and the outputs SR1, SR2, . . . of shift registers are selected at each stage in synchronization with the data. Eight-bit data is sequentially read by the first-stage latches. When all data is written into the first-stage latches, the set signal SET becomes a low level in the horizontal blanking period to reset the input to the D/A converter, and the reset signal RESET becomes a high level to set all signal lines to the same voltage. During this period, the data written into the first-stage latches is written into the second-stage latches by a latch pulse LP. The reset signal is set to a low level again to open the signal lines, and the set signal is set to a high level to connect the outputs of the D/A converter to the signal lines. The desired set timing and the desired reset timing can be set within the horizontal scanning period. It is preferred that after all signal lines should be reset to the same voltage within the horizontal blanking period, (n+m)-bit D/A-converted voltages should be applied to the signal lines. This is because, due to these operations, the signal lines can always be driven within the horizontal scanning selection period, and sufficient signals can be applied to the liquid crystal.

(Embodiment 3)

A liquid crystal display apparatus which can provide high image quality by reducing noise will be described below in the present embodiment. In general, a digital driver having a multiple-bit D/A converter is likely to receive various types of noise during conversion.

Figure 9:
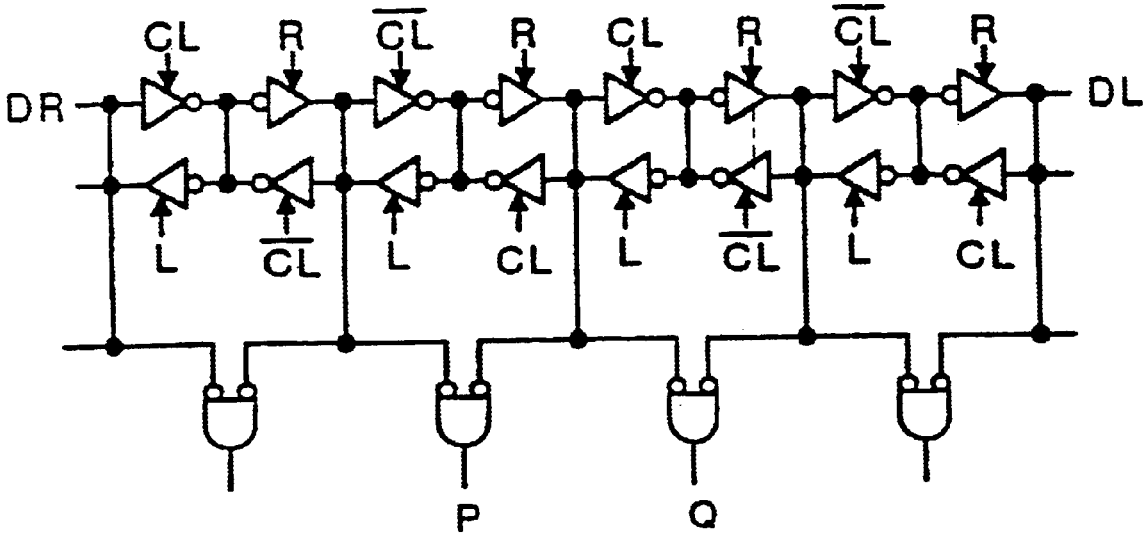
FIG. 9 is a circuit diagram of a bidirectional shift register and its timing chart.
Figure 9:
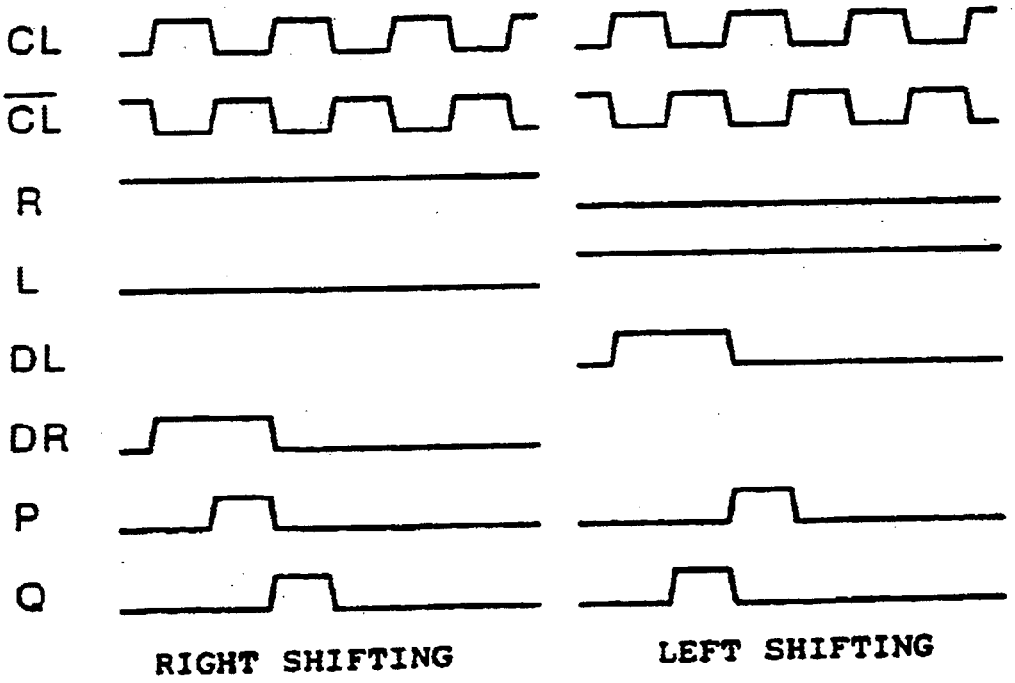

FIG. 9 shows a circuit diagram of a typical shift register circuit used for a digital driver and a timing chart thereof. In this circuit, by the use of clock signals having phases shifted by 180 degrees, a selection pulse can be shifted by a half of the period of the clock signals. This circuit transfers a pulse in either directions. A pulse is transferred in the right direction with R set to high and L set to low, and is transferred in the left direction with R set to low and L set to high. The timing of the rising edges and the falling edges of the clock signals for the shift register is the same as that of switching in each dot in a digital image signal. To minimize the effects of these clock signals and a digital data signal on the D/A converter, it is required to drive with the use of as a low voltage as possible. However, since a signal of about ±5 V usually needs to be applied to liquid crystal, the power source voltage of the D/A converter cannot be very low.

Therefore, the liquid crystal display apparatus according to the present embodiment has the following configuration. A data driver includes a CMOS static shift register, a level shifter, and a D/A converter. A scanning driver has a CMOS static shift register, a level shifter, and a buffer. These shift registers and a latch circuit are connected to a common power source. Therefore, the clock signals of the shift registers, input signals, and digital image signals are all logic signals generated by the same power source. The level shifters raise the levels of control signals for D/A converters and also raise the level of a signal input to the buffer which drives scanning lines. Since in general a CMOS static shift register can operate at a very high speed even at a low voltage and consumes a little current, it is suited as a driver for a portable liquid crystal display apparatus. According to the foregoing configuration, since all logic signals are driven by the same low power source, the interface becomes simple and noise is unlikely to occur. In addition, since a common power source can be used, it becomes possible to make the wiring to the driver inside to be very low impedance. Even if a high current flows locally, the power source voltage rarely fluctuates.

The foregoing configuration can be implemented even when a data driver LSI and a scanning driver LSI are connected to a liquid-crystal panel while the contact resistance and the wiring resistance of mounting portions are maintained at a sufficient low level. It is preferred in order to increase the advantage further that these LSI chips should be formed on the same glass substrate as a unit. In other words, as shown in FIG. 16, when a driver section is also integrated with an active matrix section by the use of poly-silicon thin-film transistors, a common power source is more likely to be used and noise can be reduced by enclosing each logic section with a wide wiring pattern.

The liquid crystal display apparatus according to the present embodiment can use various types of D/A converters. A D/A converter using a current source is likely to generate noise. It is preferred that a D/A converter which causes as a low current as required to flow should be used. For example, since a capacitor-division-type D/A converter shown in FIG. 6 only causes a current for charging and discharging the capacitor to flow, only a little noise is generated.

Figure 10A:
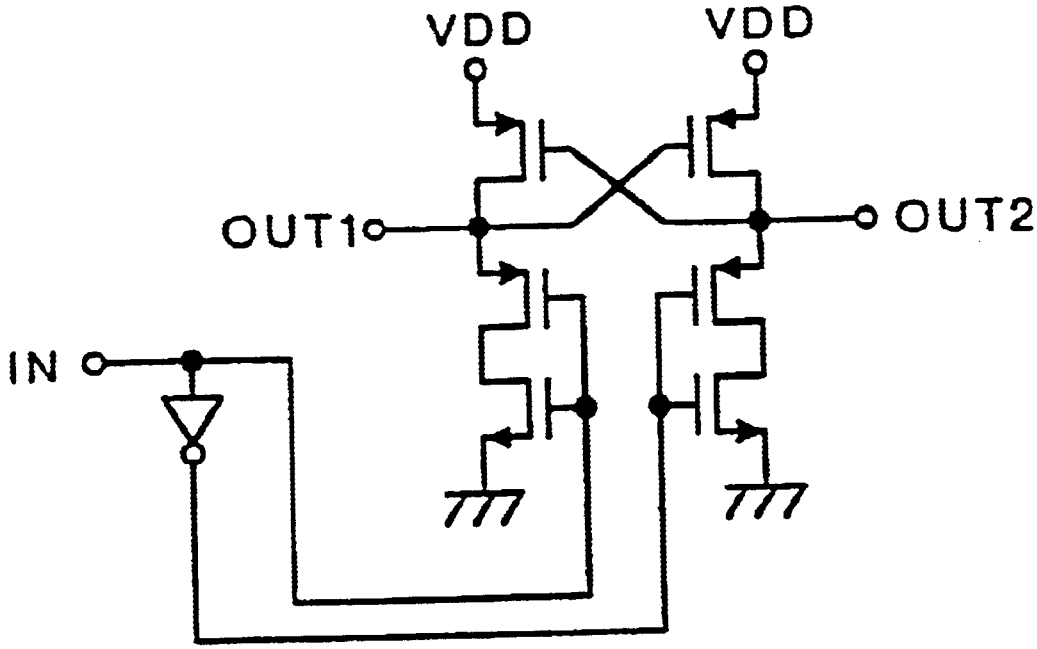
FIG. 10 is a circuit diagram of a level shifter and its timing chart.
Figure 10B:
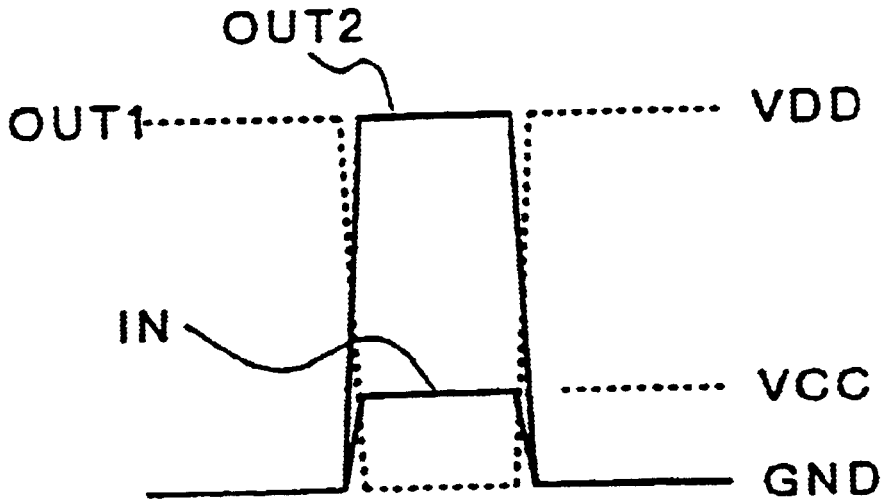

Furthermore in the present embodiment, it is preferred that a level shifter should be used which can stably shift a voltage level at a high speed with low noise. FIG. 10 shows a circuit diagram of a level shifter circuit suited to the liquid crystal display apparatus according to the present embodiment and a timing chart thereof. When a signal having the waveform shown by IN in FIG. 10(*b*) is input, a signal having the waveform shown by OUT is output. Namely, the output voltage is level shifted from the Vcc level to the VDD level. In this level shifter circuit, as shown in FIG. 10(*a*), an input section is connected to two transistors, n-channel and p-channel, connected in parallel. With this connection, a passing-through current which flows during a period from when the input of the level shifter changes to when the output is switched can be suppressed to a low level, the switching speed increases, and the shifter operates stably. Since the current consumption is also suppressed to a low level, just a low noise occurs.

(Embodiment 4)

Figure 11:
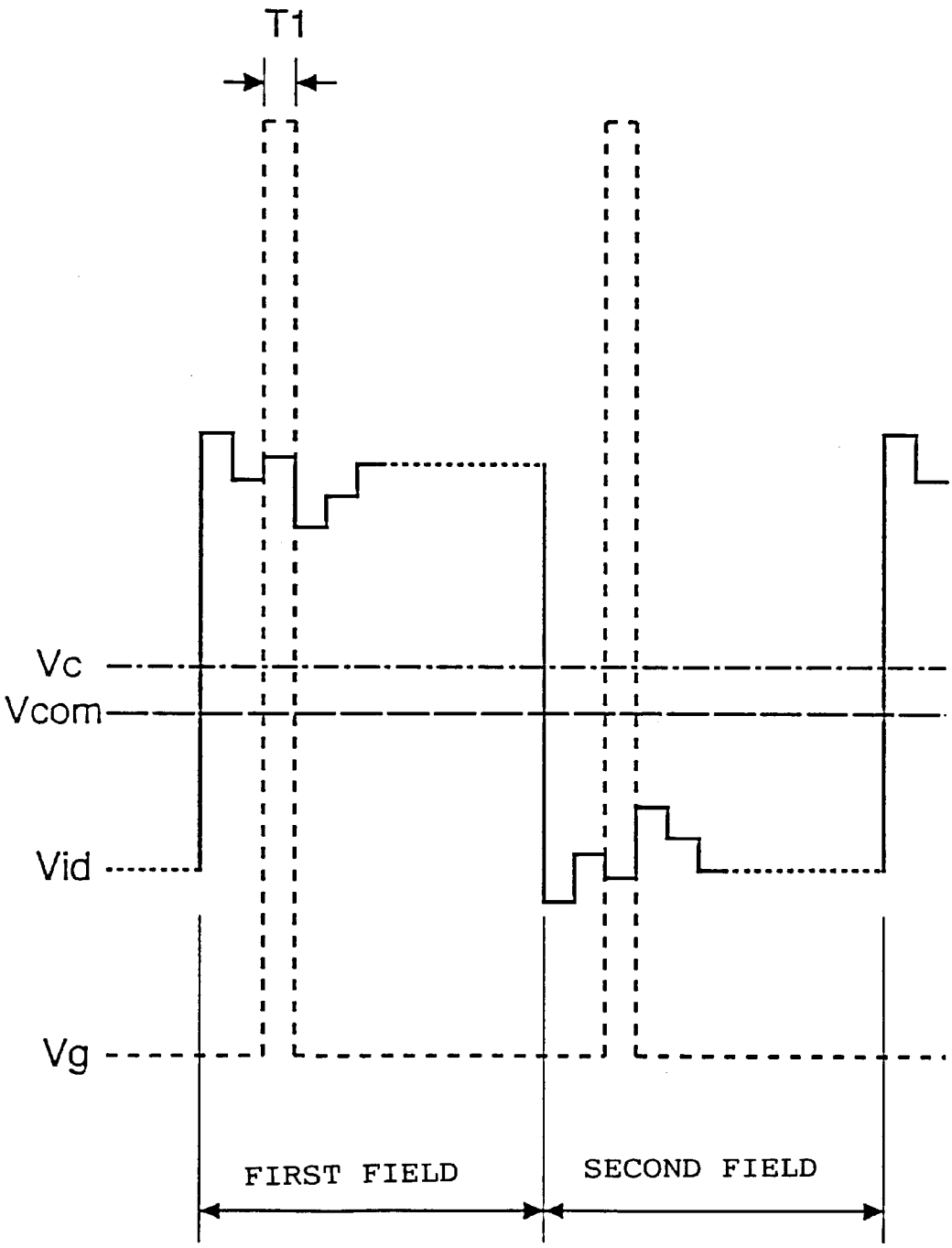
FIG. 11 is a timing chart indicating operations of a liquid crystal display apparatus.

A driving method which improves the image quality of a liquid crystal display apparatus using a D/A converter will be described in the present embodiment. FIG. 11 is a timing chart for the driving method of the liquid crystal display apparatus. Since liquid crystal needs to be AC driven, an image signal Vid is AC reversed in every field symmetrically with a certain voltage Vc. A scanning signal Vg becomes a selection level at a period T1 once per one field. This T1 corresponds to one horizontal scanning period. Since in a TFT liquid crystal display apparatus the voltage of a pixel electrode becomes lower than the voltage of a signal line by a feed-through voltage generated when a pixel TFT goes off, the common electrode voltage Vcom on the opposing substrate needs to be set lower than the image signal center voltage Vid by this feed-through voltage. In the present embodiment, the following method is used in order to AC reverse and output an image signal having a low noise in every field in the D/A converter.

A digital image signal input to the D/A converter has the same amplitude as a timing signal for the shift register. The power level of the D/A converter is switched alternately in every field to apply an AC voltage to the liquid crystal. In other words, in the driving method of the present embodiment, the voltage range of an analog signal output from the D/A converter, which is to be applied to a signal line in a field is limited, and the power source voltage for the D/A converter is set to the lowest voltage required for outputting an analog signal in that range. When liquid crystal is driven in the voltage range of 6 V±5 V, the maximum output range is 10 V. An actually necessary signal range is from about 8 V to 11 V in a field in which a positive signal is applied and is from about 1 V to 4 V in a field in which a negative signal is applied. When the power source voltage of the D/A converter is set to the minimum required voltage such that an analog signal can be output within a range of about 3 V in each field, the D/A converter consumes a low current and a low noise is generated.

The following method is more preferable. In this method, a capacitor-coupling D/A converter as shown in FIG. 6 is used and a digital input signal in which the black and white levels are not reversed is used. In the capacitor-coupling system, a power source voltage V0 for writing data can be alternately set at the positive and negative sides of a voltage COM for reset. In this case, since gray-scale voltages to be D/A converted are also reversed such that the white level and the black level are AC reversed, it is not necessary to reverse data in an external circuit in black and white. Since a circuit for reversing data at a high speed is not required, noise generation can be suppressed, and the external circuit is simplified. Of course, the current consumption is also low.

In the above-described method, since image signals having the same polarity are written for the entire screen, the lowest noise is applied to the image signals. However, if sufficient hold capacitance is not obtained in this method, flicker is likely to occur due to a difference in feed-through voltages based on the dielectric anisotropy of liquid crystal. If the wiring resistance of scanning lines and capacitor lines is not sufficiently reduced, luminance unevenness at the left and right and crosstalk between the left and right are likely to occur due to delays. The following method avoids these problems.

D/A converters are provided in multiple, separate systems and power sources therefor are also connected with separate wiring. A digital image signal input to a D/A converter has the same amplitude as a timing signal for a shift register. The power levels of the D/A converters are switched alternately in every field to apply an AC voltage to the liquid crystal. The power source voltages of D/A converters connected to odd-number-row signal lines and the power source voltages of D/A converters connected to even-number-row signal lines are shifted by 180 degrees in phase and switched alternately. In other words, image signals having reverse polarities are always applied to adjacent signal lines in this driving method. Therefore, there exist the same numbers of pixels to which a positive-polarity signal is written and pixels to which a negative-polarity signal is written, and flicker becomes unnoticeable. Since charges applied to a pixel is compensated for to some extent between adjacent pixels through scanning lines and capacitor lines, luminance unevenness at the left and right and crosstalk between the left and right are unlikely to occur. Since the power source voltage of the D/A converter is set to the minimum required voltage such that analog output ranges required for positive polarity and negative polarity are covered, the D/A converter consumes a low current and a low noise is generated. If the D/A converter is not provided with a black-and-white reverse function in this method, it is necessary to provide multiple data lines and input a positive-polarity signal and a negative-polarity signal separately.

A more preferable driving method will be described below. In this method, a capacitor-coupling D/A converter such as that shown in FIG. 6 is used and a digital input signal in which the black and white levels are not reversed is used. As described before, since a black-and-white reverse function is provided for the D/A converter itself in this method, it is not necessary to provide data wiring in multiple systems. Since a circuit for reversing data at a high speed is not required, noise generation can be suppressed, and the external circuit is simplified. The current consumption is also low.

A driving method for avoiding crosstalk in the signal-line direction will also be described below. D/A converters are provided in multiple, separate systems and power sources therefor are also connected with separate wiring. A digital image signal input to a D/A converter has the same amplitude as a timing signal for a shift register. The power level of the D/A converter is switched alternately in every horizontal scanning period to apply an AC voltage to the liquid crystal. The power source voltages of D/A converters connected to odd-number-row signal lines and the power source voltages of D/A converters connected to even-number-row signal lines are shifted by 180 degrees in phase and switched alternately. In other words, image signals having reverse polarities are always applied to adjacent signal lines in this driving method. In addition, the polarities are AC reversed in every horizontal scanning period, a signal having the reverse polarity is written into adjacent pixels left and right, and upper and lower. With this, flicker becomes unnoticeable. Since charges applied to a pixel is compensated for to some extent between adjacent pixels through scanning lines and capacitor lines, luminance unevenness in the horizontal direction and crosstalk in the horizontal direction are unlikely to occur. Luminance unevenness in the vertical direction and crosstalk in the vertical direction are unlikely to occur because the average voltage of signal lines becomes almost constant irrespective of an image signal. Namely, this method improves luminance uniformity in both horizontal and vertical directions and suppresses crosstalk. Since the power source voltage of the D/A converter is set to the minimum required voltage such that analog output ranges required for positive polarity and negative polarity are covered, the D/A converter consumes a low current and a low noise is generated. If the D/A converter is not provided with a black-and-white reverse function in this method, it is necessary to provide multiple data lines and input a positive-polarity signal and a negative-polarity signal separately.

A more preferable driving method will be described below. In this method, a capacitor-coupling D/A converter such as that shown in FIG. 6 is used and a digital input signal in which the black and white levels are not reversed is used. As described before, since a black-and-white reverse function is provided for the D/A converter itself in this method, it is not necessary to provide data wiring in multiple systems. Since a circuit for reversing data at a high speed is not required, noise generation can be suppressed, and the external circuit is simplified. The current consumption is also low.

(Embodiment 5)

Figure 12:
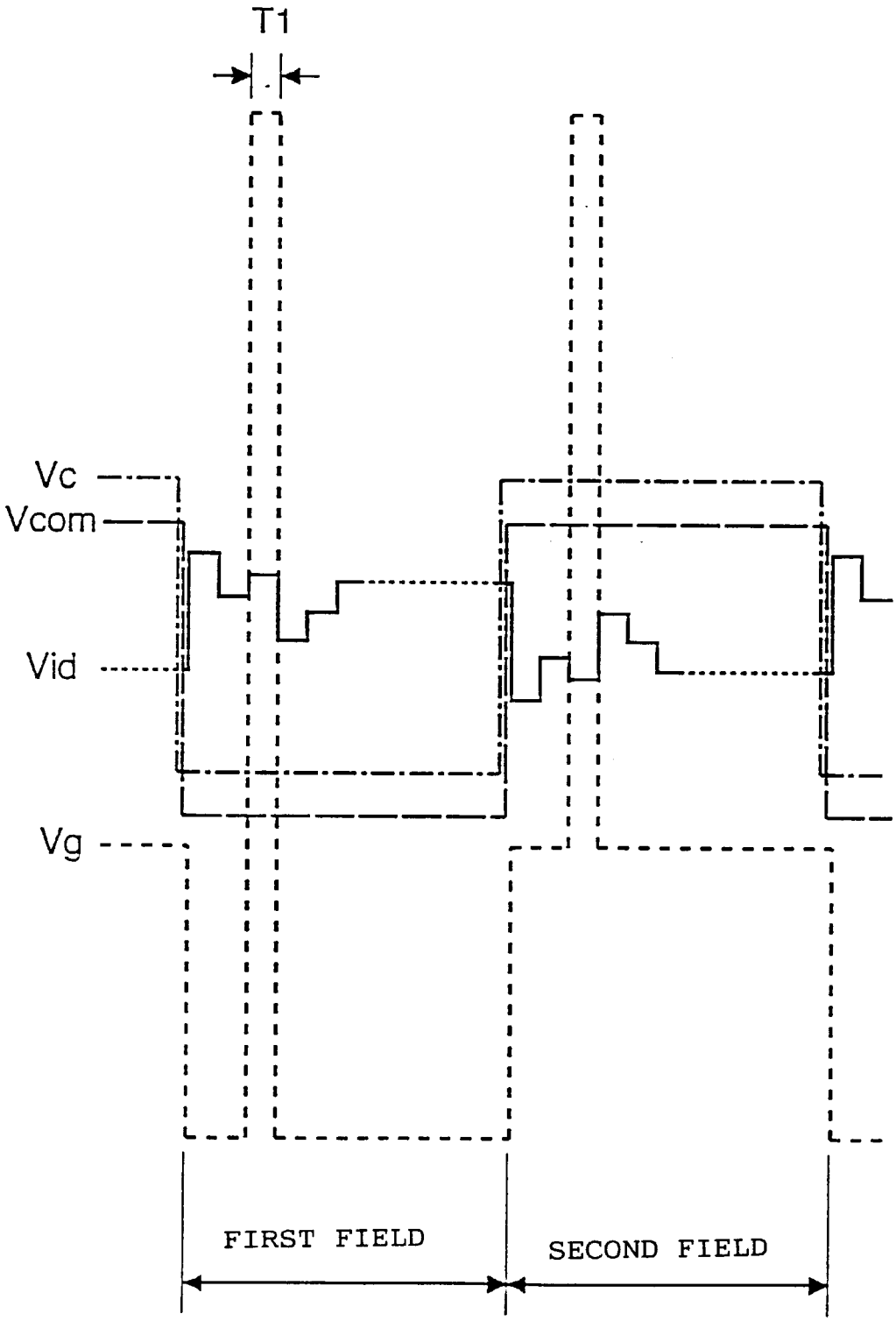
FIG. 12 is a timing chart indicating operations of a liquid crystal display apparatus.

A second driving method for improving the image quality of a liquid crystal display apparatus using a D/A converter will be described in this embodiment. In the driving method shown in FIG. 11, the power source voltage for the D/A converter needs to be changed alternately at a large amplitude. A method for reducing the amplitude of the voltage will be described here. FIG. 12 is a timing chart for a driving method of a liquid crystal display apparatus. Since liquid crystal needs to be AC driven, an image signal Vid is AC reversed in every field symmetrically with a certain voltage Vc. Vc is also AC driven in the reverse phase in every field. As a result, the voltage range of the image signal Vid is much reduced as compared with that shown in FIG. 11. In synchronization with Vc, a common electrode voltage Vcom on the opposing substrate is also AC driven. Since in a TFT liquid crystal display apparatus the voltage of a pixel electrode becomes lower than the voltage of a signal line by a feed-through voltage generated when a pixel TFT goes off, the common electrode voltage Vcom on the opposing substrate needs to be set lower than the image signal center voltage Vid by this feed-through voltage. When a hold capacitor is connected to a special capacitor line, namely, in a storage capacitor system, the capacitor line needs to be driven with the same waveform as that for Vcom. If the hold capacitor is connected to a scanning line of the previous stage, namely, in an additional capacitor system, a not-selection voltage is shifted in parallel in synchronization with Vcom as shown in FIG. 12. In the present embodiment, in order to AC reverse and output an image signal having a low noise in every field by the D/A converter, a digital image signal input to the D/A converter has the same amplitude as a timing signal for a shift register. The power level of the D/A converter is switched alternately in every field to apply an AC voltage to the liquid crystal. In this method, since the ranges of analog signals output from the D/A converter, which are to be applied to signal lines, do not have a large voltage difference between the positive polarity and the negative polarity, it is not necessary for the power source of the D/A converter to have a large amplitude.

A more preferable driving method will be described below. In this method, a capacitor-coupling D/A converter such as that shown in FIG. 6 is used and a digital input signal in which the black and white levels are not reversed is used. Since a circuit for reversing data at a high speed is not required, noise generation can be suppressed, and the external circuit is simplified. The current consumption is also low.

A driving method for avoiding crosstalk in the signal-line direction will also be described below in the present embodiment. Since liquid crystal needs to be AC driven, an image signal Vid is AC reversed in every horizontal scanning period symmetrically with a certain voltage Vc. Vc is also AC driven in the reverse phase in every horizontal scanning period. In synchronization with Vc, a common electrode voltage Vcom on the opposing substrate is also AC driven in every horizontal scanning period. Since in a TFT liquid crystal display apparatus the voltage of a pixel electrode becomes lower than the voltage of a signal line by a feed-through voltage generated when a pixel TFT goes off, the common electrode voltage Vcom on the opposing substrate needs to be set lower than the image signal center voltage Vid by this feed-through voltage. When a hold capacitor is connected to a special capacitor line, namely, in the storage capacitor system, the capacitor line needs to be driven with the same waveform as that for Vcom. If the hold capacitor is connected to a scanning line in the previous stage, namely, in the additional capacitor system, a not-selection voltage is shifted in parallel in synchronization with Vcom. In this method, since signals having reverse polarities are applied to a signal line in every horizontal scanning period, flicker becomes unnoticeable, and luminance unevenness and crosstalk in the vertical direction also become unnoticeable.

A more preferable driving method will be described below. In this method, a capacitor-coupling D/A converter such as that shown in FIG. 6 is used and a digital input signal in which the black and white levels are not reversed is used. Since a circuit for reversing data at a high speed is not required, noise generation can be suppressed, and the external circuit is simplified. The current consumption is also low.

(Embodiment 6)

Figure 13:
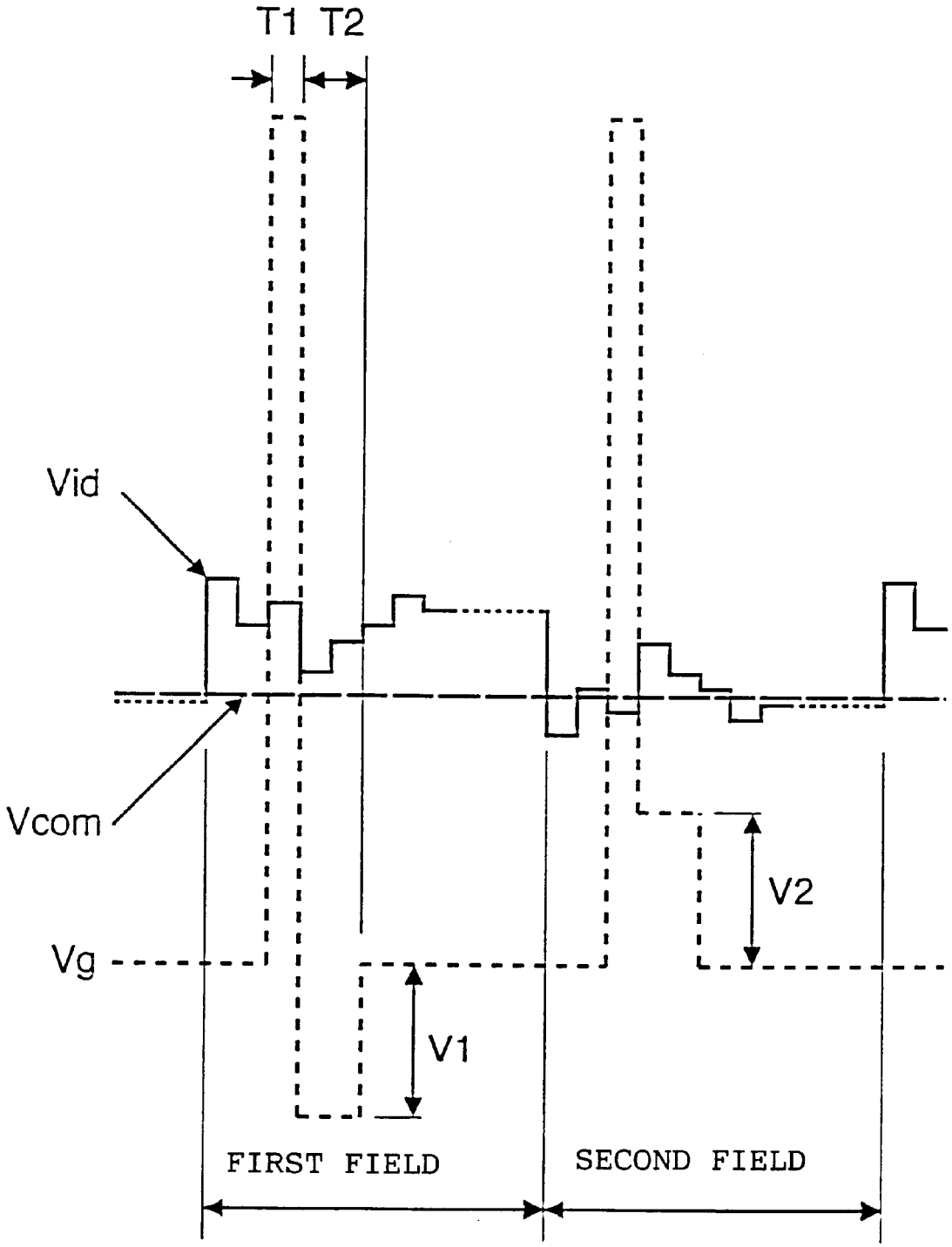
FIG. 13 is a timing chart indicating operations of a liquid crystal display apparatus.

A third driving method for improving the image quality of a liquid crystal display apparatus using a D/A converter will be described in this embodiment. In the driving method shown in FIG. 12, since the common electrode of the opposing substrate is AC driven, power consumption becomes slightly large. In the present embodiment, a driving method in which power consumption is relatively small while the power source voltage range of a D/A converter is narrowed will be described. The present embodiment can be applied to a case in which a hold capacitor is connected to a scanning line of the previous stage, namely, the additional capacitor system is used. FIG. 13 is a timing chart for the driving method of the liquid crystal display apparatus. An image signal Vid which is the same as that used in FIG. 12 is used, whereas the common electrode voltage Vcom on the opposing substrate is constant. A scanning signal has four voltage levels. Switched in every field are a case in which a non-selection voltage or more is maintained for a certain period before the scanning signal changes from the selection voltage to the non-selection voltage immediately after the selection period, and a case in which a non-selection voltage or less is maintained for the same situation. For example, in FIG. 13, after the selection period T1, the scanning signal is set to a voltage different from the non-selection voltage for two horizontal scanning periods, T2. In the figure, since the voltage of the hold capacitor is increased by V1 in the first field after T2 and reduced by V2 in the second field, an AC voltage is applied to liquid crystal in the same way as in a case in which the common electrode voltage is AC driven. In the present embodiment, in order to AC reverse and output an image signal having a low noise in every field by the D/A converter, a digital image signal input to the D/A converter has the same amplitude as a timing signal for a shift register. The power level of the D/A converter is switched alternately in every field to apply an AC voltage to the liquid crystal. In this method, since the ranges of analog signals output from the D/A converter, which are to be applied to signal lines, do not have a large voltage difference between the positive polarity and the negative polarity, it is not necessary for the power source of the D/A converter to have a large amplitude. Since the common electrode voltage is constant, the power consumption of the liquid crystal display apparatus is smaller than that in the case shown in FIG. 12.

A more preferable driving method will be described below. In this method, a capacitor-coupling D/A converter such as that shown in FIG. 6 is used and a digital input signal in which the black and white levels are not reversed is used. Since a circuit for reversing data at a high speed is not required, noise generation can be suppressed, and the external circuit is simplified. The current consumption is also low.

A driving method for avoiding crosstalk in the signal-line direction will also be described below in the present embodiment. Since liquid crystal needs to be AC driven, an image signal Vid is AC reversed in every horizontal scanning period symmetrically with a certain voltage Vc. Vc is also AC driven in the reverse phase in every horizontal scanning period. The common electrode is set to a constant voltage. The waveform in which the scanning signal holds the non-selection voltage or less immediately after the selection period as indicated by the selection signal in the first field in FIG. 13, and the waveform in which the scanning signal holds the non-selection voltage or more immediately after the selection period as in the second field are alternately repeated in every horizontal scanning period. With this operation, since a signal having the reverse polarity is applied to a signal line in every horizontal scanning period, flicker becomes unnoticeable, and luminance unevenness and crosstalk in the vertical direction also become unnoticeable.

A more preferable driving method will be described below. In this method, a capacitor-coupling D/A converter such as that shown in FIG. 6 is used and a digital input signal in which the black and white levels are not reversed is used. Since a circuit for reversing data at a high speed is not required, noise generation can be suppressed, and the external circuit is simplified. The current consumption is also low.

(Embodiment 7)

Figure 14:
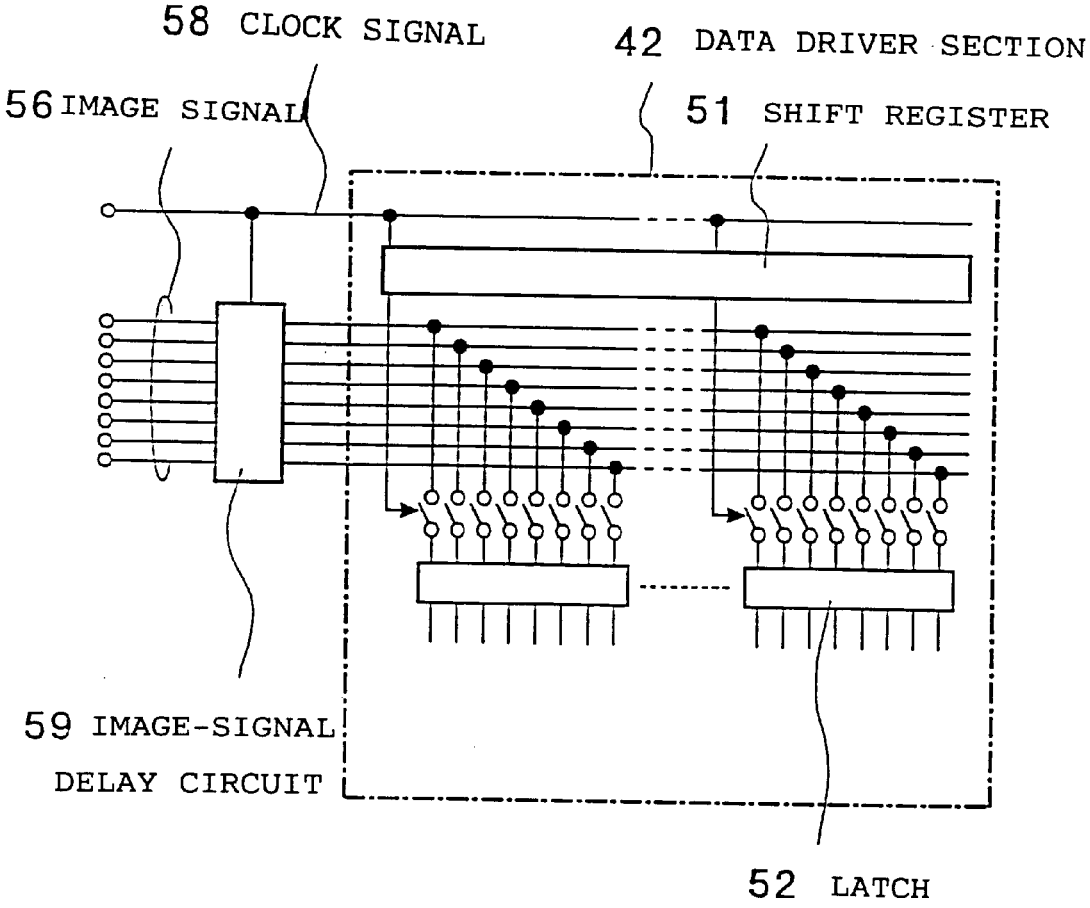
FIG. 14 is a circuit diagram of a data input section of a liquid crystal display apparatus.

A delay time in a driver circuit for a liquid crystal display apparatus is focused on in the present embodiment, and means for improving image quality will be described. In general, in a liquid crystal display apparatus using a digital data driver, it is preferred that the driver should be driven at a low voltage in order to reduce the effects of noise on the screen as much as possible. In contrast, the operating speed of the driver has been increasing due to a demand for high resolution on the screen. Therefore, an actual image may be displayed with a shift because of a delay time in the driver. Alternatively, to avoid this delay time, low voltage driving may not be achieved. In the liquid crystal display apparatus according to the present embodiment, as shown in FIG. 14, the data driver is provided with a delay circuit 59 at a section to which an image signal 59 is input. In the data driver, a shift register 42 shifts the selection pulse of a latch 52 step by step at a timing of a clock signal 58. As the driver logic section is driven by a lower voltage, due to a delay time in the shift register and that in the latch circuit, an image signal is read at a more delayed timing. The delay time in the driver is estimated in simulation or actually measured in advance, and when the image signal 56 is delayed by that delay time by the delay circuit 59, the data is read at the correct timing. The delay circuit can be any circuits if digital data is delayed by the required time. It can be formed by flip-flops, or inverters connected in multiple stages. Since an image on the screen does not shift in this method, the voltage for the logic section can be reduced and noise on the screen is reduced.

Figure 15:
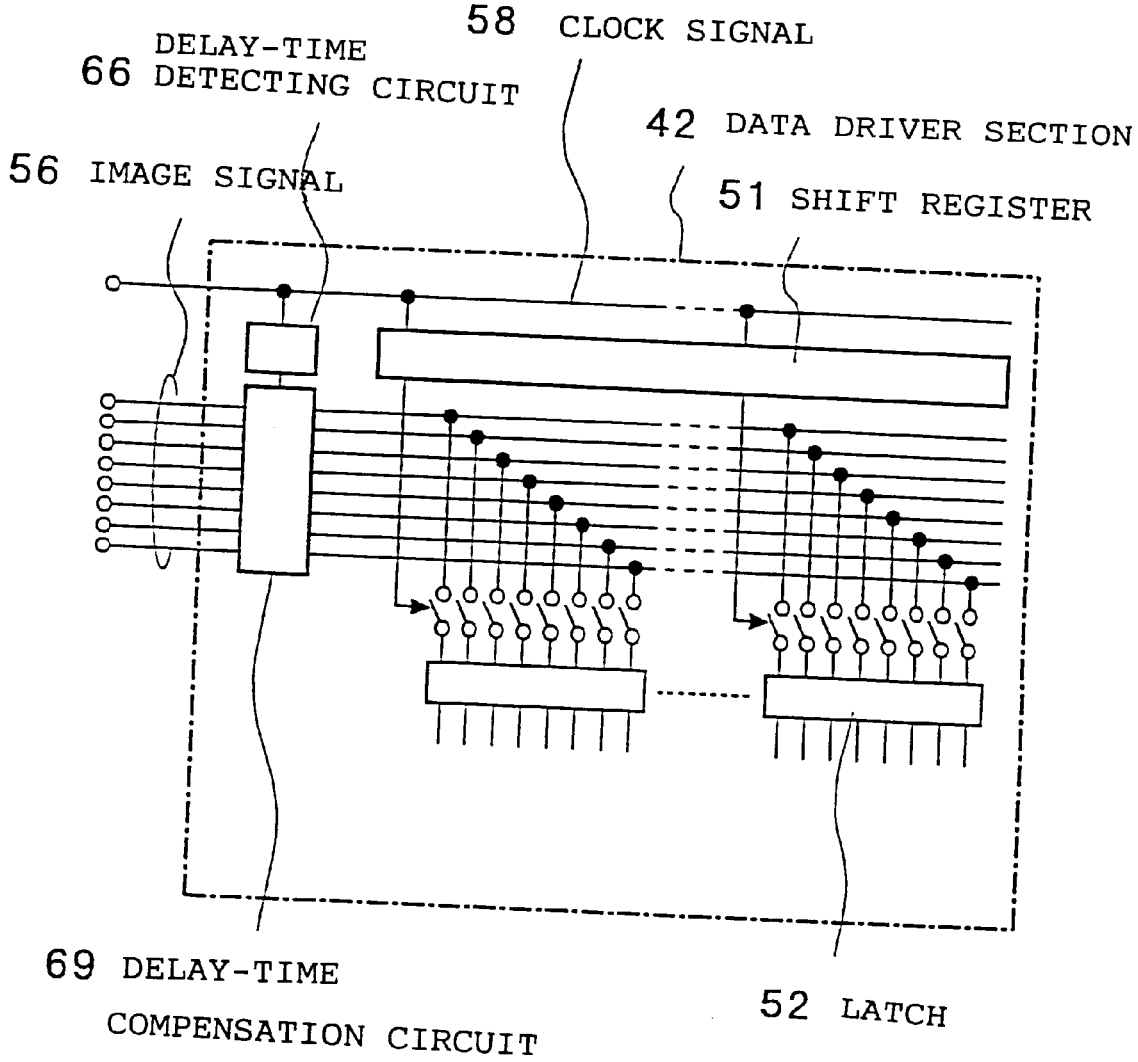
FIG. 15 is a circuit diagram of a data input section of a liquid crystal display apparatus.
Figure 16A:
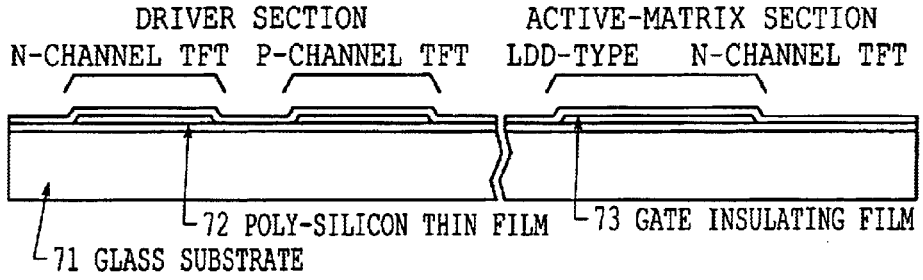
FIG. 16 a cross section showing a manufacturing process for a poly-silicon TFT.
Figure 16B:
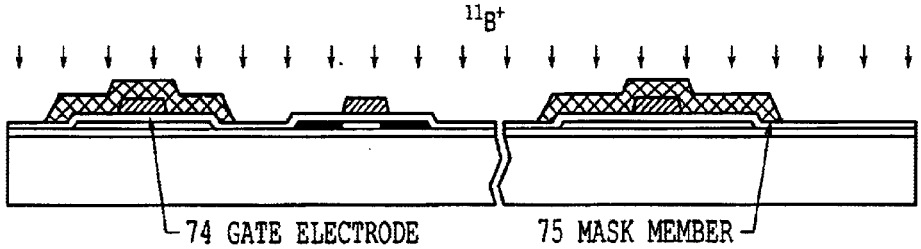
Figure 16C:
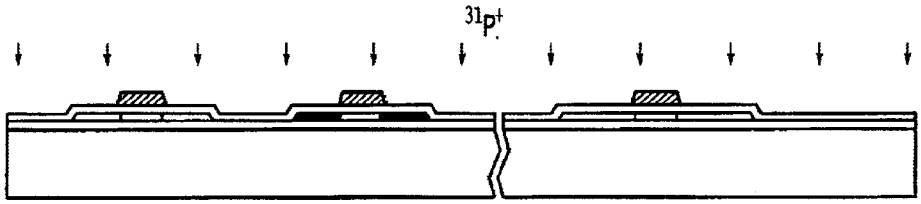
Figure 16D:
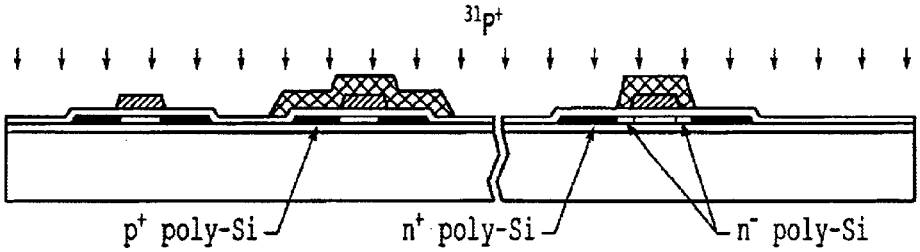
Figure 16E:
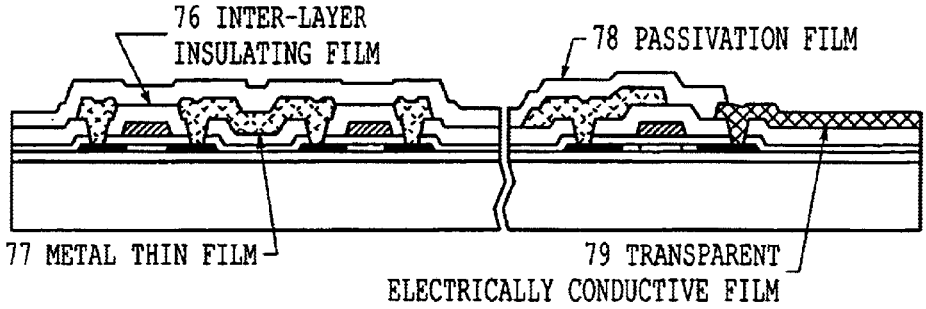

In addition, it is ideally preferred that a delay time for each driver should be compensated for. As shown in FIG. 15, the data driver section is provided with a delay-time detecting circuit 66 and a delay-time compensation circuit 69. The delay-time detecting circuit is formed by the same circuit as that or devices having the same dimensions as those of the devices for one stage in the shift register 51 and the latch 52 such that the same delay time is generated, and a pulse delayed from the clock signal 58 by that delay time is generated. The image signal 56 is required to be input through the delay-time compensation circuit 69 with this pulse being used as a trigger. In this method, if each driver has a different delay time due to variation in the process conditions of the driver, an image displayed on the screen does not shift. If the delay time in the driver shifts due to operations at low and high temperatures even in the same liquid crystal display apparatus, no problem occurs.

When the driver circuit is integrated on an active-matrix substrate, the liquid crystal display apparatus according to the present embodiment achieves the maximum advantages. As shown in FIG. 16, in a liquid crystal display apparatus in which peripheral driver circuits are integrated by the use of CMOS poly-silicon TFTs formed on the glass substrate, since the mobility of the poly-silicon TFT is just around one fifth that of a single-crystal silicon, the driver has a long delay time. Since a poly-silicon TFT is not a single crystal, drivers may vary depending on process-condition variation. Therefore, with the use of the image-signal delay circuit, the delay-time detecting circuit, and the delay-time compensation circuit of the present embodiment, the liquid crystal display apparatus having the driver in it can provide high image quality.

A driving method for the liquid crystal display apparatus according to the present embodiment will be described below. First a case will be described in which the image-signal delay circuit shown in FIG. 14 is used. In general, since a luminance signal and a timing signal are sent to a liquid crystal display apparatus at the same time as image-signal data, the clock signal 58 and an image signal 56 can be easily formed in an external synchronization circuit. These two signals are synchronized and have no shift in timing. The delay time generated in the shift register 51 and that in the latch 52 when this clock signal is used are accurately estimated in simulation or actually measured. The image signal 56 is delayed by this estimated delay time by the image-signal delay circuit 59. As a result, the delay time of an image signal read by the latch and the delay time required for the operations of the shift register and the latch circuit are synchronized. In other words, image-signal data is read at an ideal timing and there is no shift on the screen.

In the same way, a case will be described in which the circuit shown in FIG. 15 is used. The clock signal 58 and an image signal 56 formed in an external synchronization circuit are also used. These two signals are synchronized and there is no shift in timing. The delay time generated in the shift register 51 and that in the latch 52 when this clock signal is used are detected by the delay-time detecting circuit 66. The image signal 56 is delayed by this detected delay time by the image-signal compensation circuit 69. As a result, the delay time of an image signal read by the latch and the delay time required for the operations of the shift register and the latch circuit are synchronized. In this method, since a shift in the delay time is self-compensated for, even if the apparatus is driven under any conditions, image-signal data is always read at an ideal timing and there is no shift on the screen.

(Embodiment 8)

Figure 17:
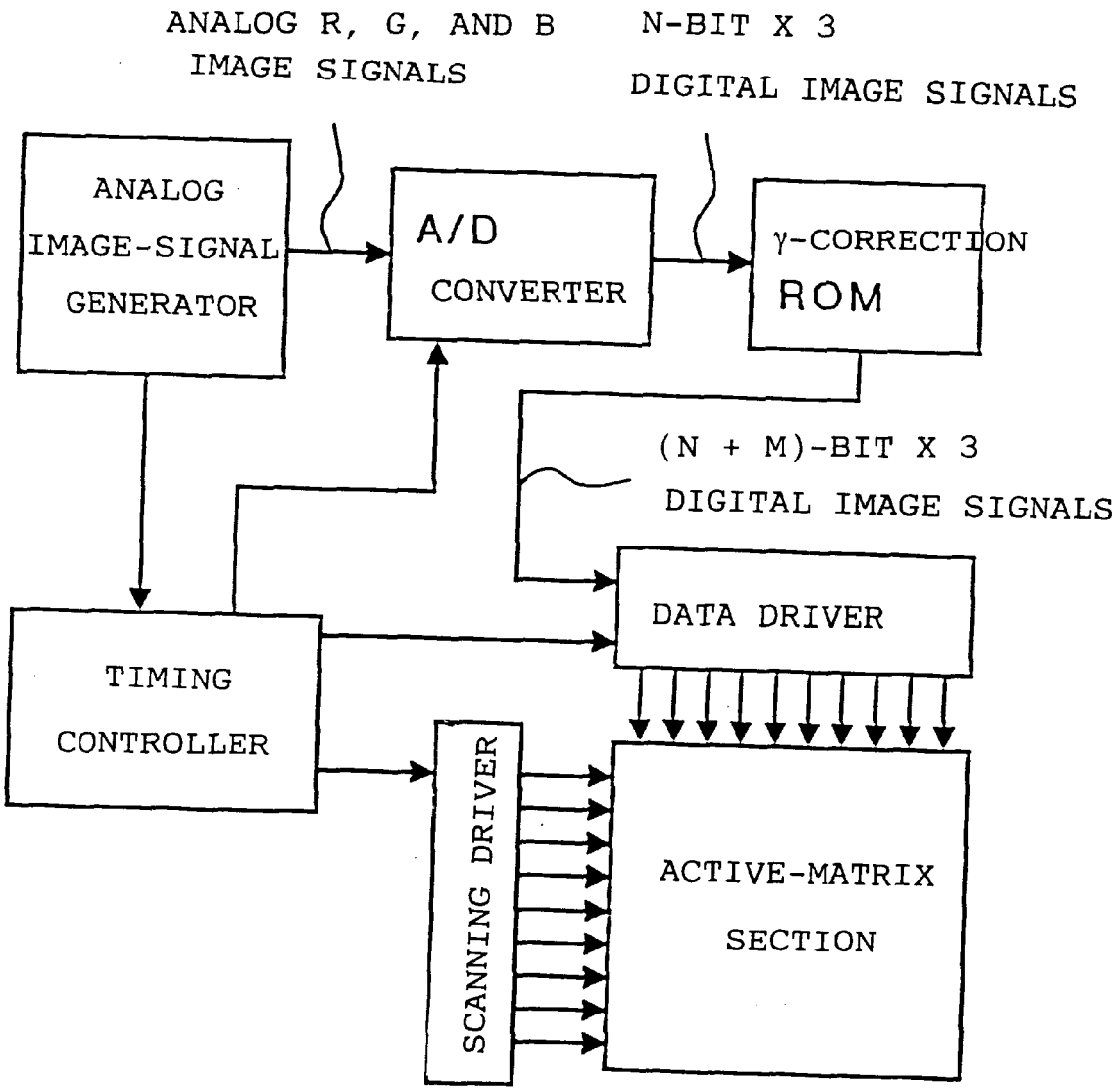
FIG. 17 is a block diagram of a display system using a liquid crystal display apparatus.

A display system using a liquid crystal display apparatus in which a D/A converter is built will be described below in the present embodiment. In FIG. 17, analog R, G, and B image signals generated by an analog image signal generator such as a computer are converted to (n-bit×3) digital signals by a D/A converter. When a video unit is used as a signal source, signals are converted to analog R, G, and B image signals and input to a D/A converter. When a signal source generates a digital image signal, this D/A converter is unnecessary. These (n-bit×3) digital image signals are sequentially converted to (n+m)-bit×3 digital image signals by a g-correction ROM. The converted image signals are sent to a data driver. On the other hand, a timing controller generates driving signals for the A/D converter, the data driver, and a scanning driver in synchronization with the signals generated by the analog image-signal generator. The data driver sequentially reads the (n+m)-bit×3 image signals in latches in synchronization with the clock signal received from the timing controller and drives signal lines of an active-matrix section through a (n+m)-bit×3 D/A converter. The image signals are written into pixels at scanning lines selected by the scanning driver, and displayed on the screen of the active-matrix section. In this display system, since g correction is achieved by a table written into the ROM, complicated power sources are not needed. In addition, since all gray-scale signals can be compensated for, superior color display is possible.

To use the display system according to the present embodiment as a portable system, it is necessary to suppress current consumption as much as possible. It is preferred that the output signals of the A/D converter, the input and output signals of the g-correction ROM, the output signals of the timing controller, the input signals of the data driver, and the input signals of the scanning driver should have the same voltage amplitude and each section should be driven as a low voltage as possible. The voltage is raised by a level shifter, if required. A low power consumption is further achieved by the use of two levels of power sources for the D/A converter in a case for applying a positive-polarity signal and in a case for applying a negative-polarity signal.

When an image signal is written onto the screen at a high speed with the use of a low-voltage logic circuit, a shift is likely to occur on the screen. Therefore, it is preferred that a delay time in the display system should be optimized. In other words, in FIG. 17, a total delay time in the D/A converter and the g-correction ROM is set equal to a delay time from the clock signal to when image signal data is latched in the data driver. If the delay time in the data driver is too long, a delay circuit is additionally provided for the digital image signal input section of the data driver and the sum of a delay time in this delay circuit and the total delay time in the A/D converter and the g-correction ROM is set equal to the delay time in the data driver.

If portability is the biggest concern, it is preferred that an active-matrix liquid crystal display apparatus in which peripheral driving circuits are integrated be used. In other words, with the use of a poly-silicon TFT circuit formed on a glass substrate as shown in FIG. 16, a driver circuit is formed around an active-matrix section. Then, the system is made compact and lightweight.

An electronic gear formed by the liquid crystal display apparatus according to the above embodiment includes a display information output source 1000, a display information processing circuit 1002, a display driving circuit 1004, a display panel 1006 such as a liquid crystal panel, a clock generating circuit 1008, and a power circuit 1010. The display information output source 1000 has memory devices such as ROM and RAM and a tuning circuit for tuning a TV signal and outputting it, and outputs display information such as a video signal according to a clock sent from the clock generating circuit 1008. The display information processing circuit 1002 handles and outputs display information according to a clock sent from the clock generating circuit 1008. The display information processing circuit 1002 can include, for example, an amplification and polarity-reversing circuit, a phase expansion circuit, a rotation circuit, a gamma-correction circuit, and a clamping circuit. The display driving circuit 1004 includes a scanning driving circuit and a data driving circuit, and drives the liquid crystal panel 1006. The power circuit 1010 supplies power to each of the above-described circuits.

Figure 19:
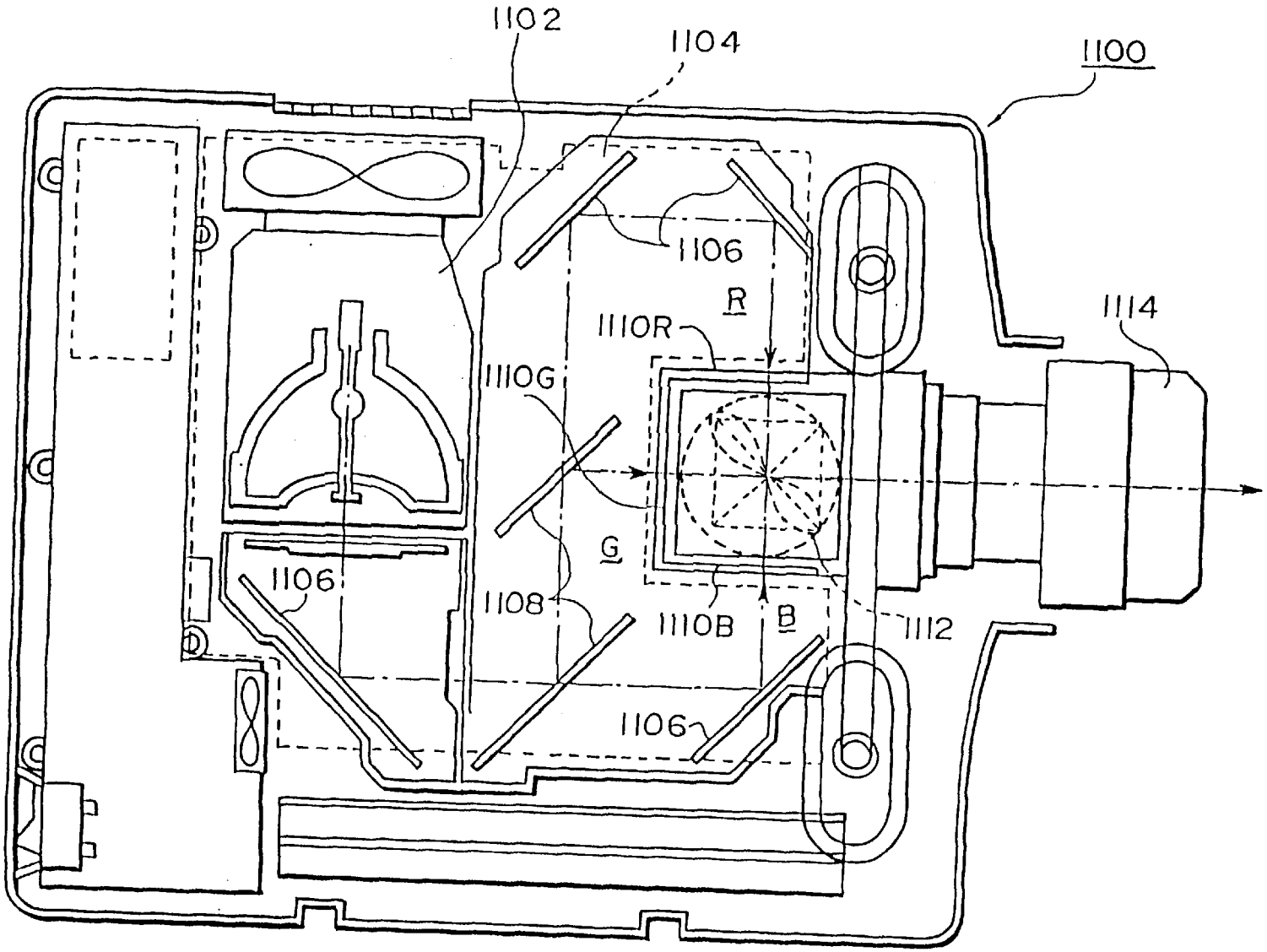
FIG. 19 is a view illustrating a liquid crystal projector to which the present invention is applied.
Figure 20:
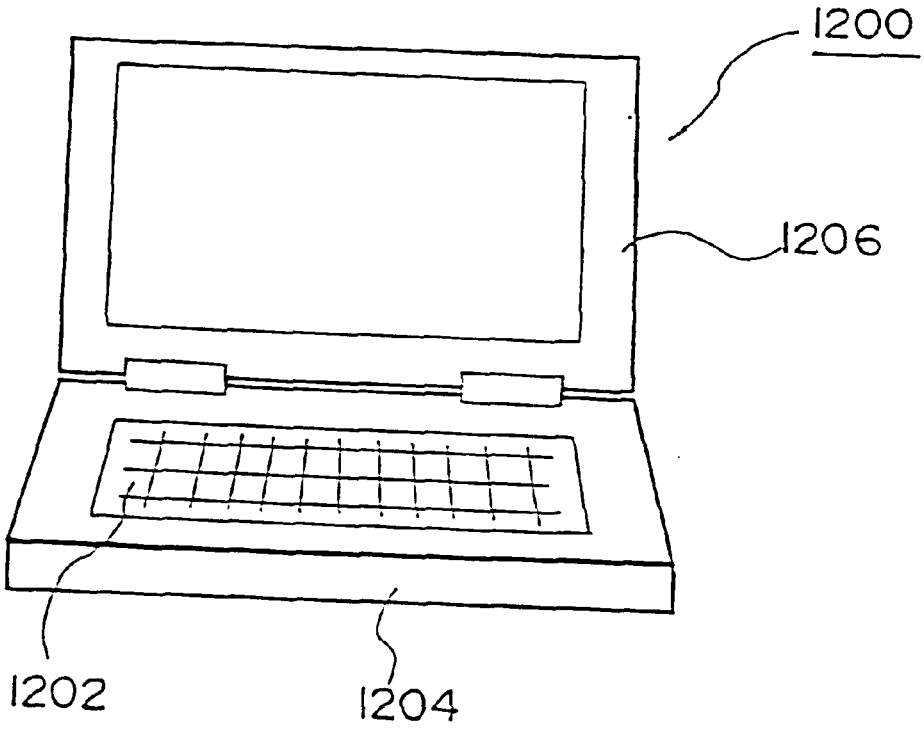
FIG. 20 is a view showing a personal computer (PC) for multimedia, to which the present invention is applied.
Figure 21:
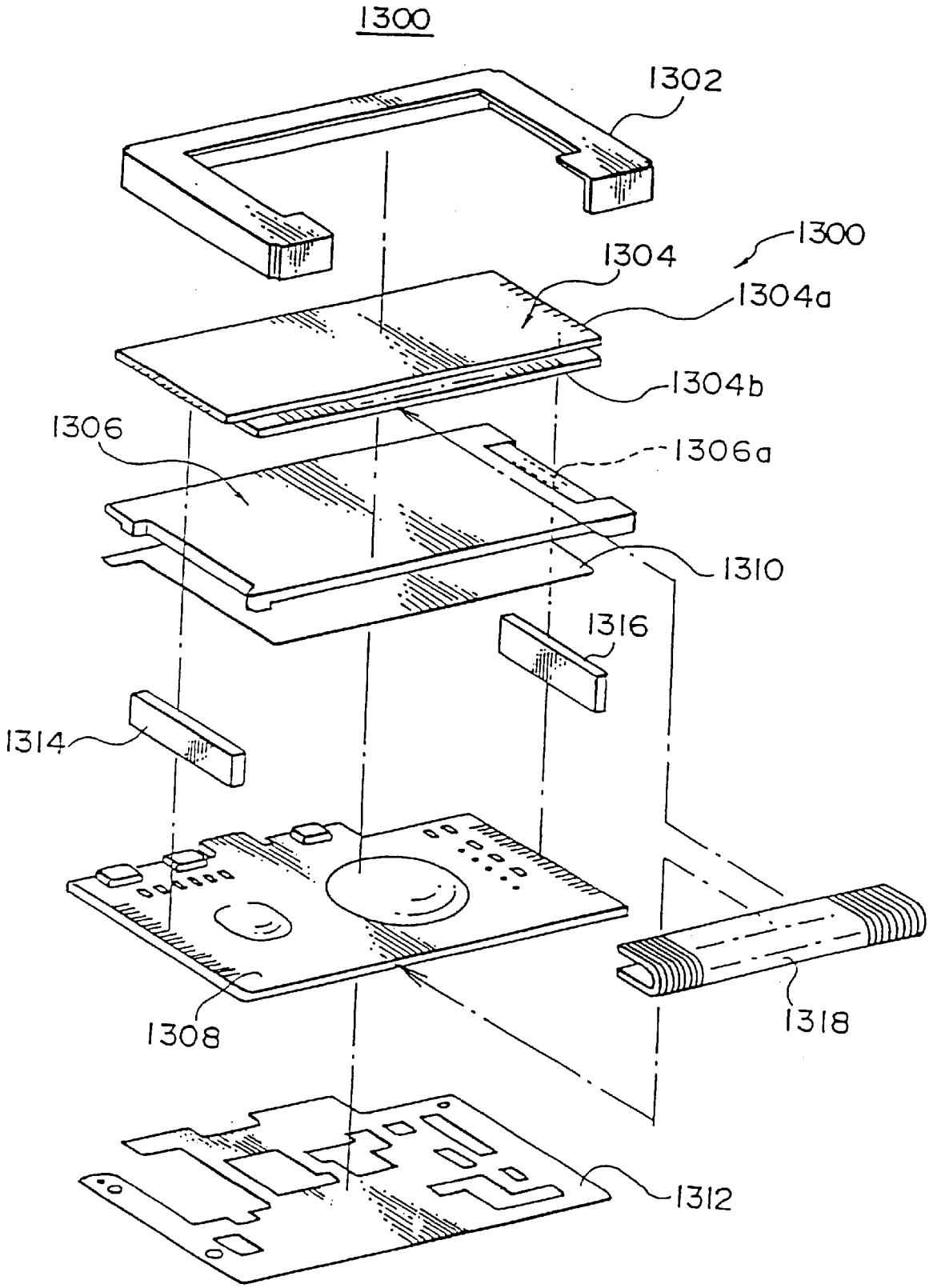
FIG. 21 is a view illustrating a pager to which the present invention is applied.

As electronic gears having such a configuration, a liquid crystal projector shown in FIG. 19, a personal computer (PC) and an engineering workstation (EWS) for multimedia shown in FIG. 20, a pager shown in FIG. 21, a portable phone, a word processor, a TV set, a video tape recorder with a viewfinder or with a monitor, an electronic pocket book, an electronic calculator, a car navigation system, a POS terminal, and a unit having a touch-sensitive panel can be considered.

The liquid crystal projector shown in FIG. 19 is a projection-type projector using a transmission-type liquid crystal panel as a light bulb. It uses, for example, an optical system of a three-plate prism system.

In FIG. 21, in the projector 1100, projection light emitted from a lamp unit 1102 serving as a white-light source is divided into three primary colors, R, G, and B, by a plurality of mirrors 1106 and two dichroic mirrors 1108 in the light guide 1104, and led to three liquid crystal panels 1110R, 1110G, and 1110B which are used for displaying these colors. The light modulated by the liquid crystal panels 1110R, 1110G, and 1110B is incident on a dichroic prism 1112 in three different directions. The red light and the blue light are deflected by 90 degrees and the green light goes straight in the dichroic prism 1112, each color image is combined, and the combined color image is projected on a screen through a projection lens 1114.

The personal computer 1200 shown in FIG. 20 includes a body section 1204 equipped with a keyboard 1202 and a liquid crystal display screen 1206.

The pager 1300 shown in FIG. 21 includes a liquid crystal display board 1304, a light guide 1306 equipped with a back light 1306*a*, a circuit board 1308, first and second shielding plates 1310 and 1312, two elastic electrically conductive members 1314 and 1316, and a film carrier tape 1318 in a metal frame 1302. The two elastic electrically conductive members 1314 and 1316, and the film carrier tape 1318 are used for connecting the liquid crystal display board 1304 to the circuit board 1308.

Figure 18:
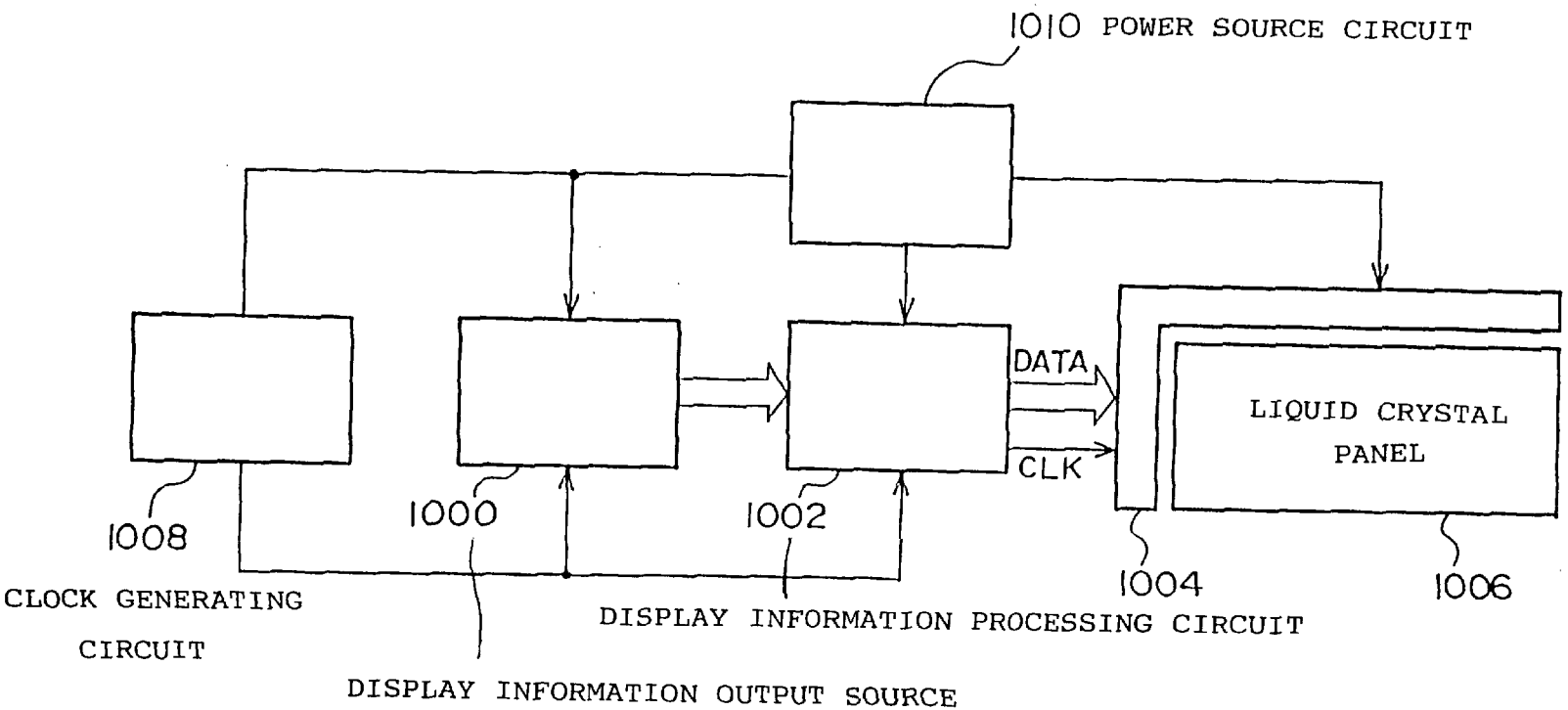
FIG. 18 is a view showing an electronic gear to which the present invention is applied.

The liquid crystal display board 1304 is formed by two transparent substrates 1304*a* and 1304*b* with liquid crystal being sealed therebetween, and serves at least as a dot-matrix liquid crystal display panel. On one transparent substrate, the driving circuit 1004 shown in FIG. 18 or, in addition, the display information processing circuit 1002, can be formed. Circuits not mounted on the liquid crystal display board 1304 are treated as external circuits of the liquid crystal display board. In a case shown in FIG. 23, they can be mounted on the circuit board 1308.

Figure 22:
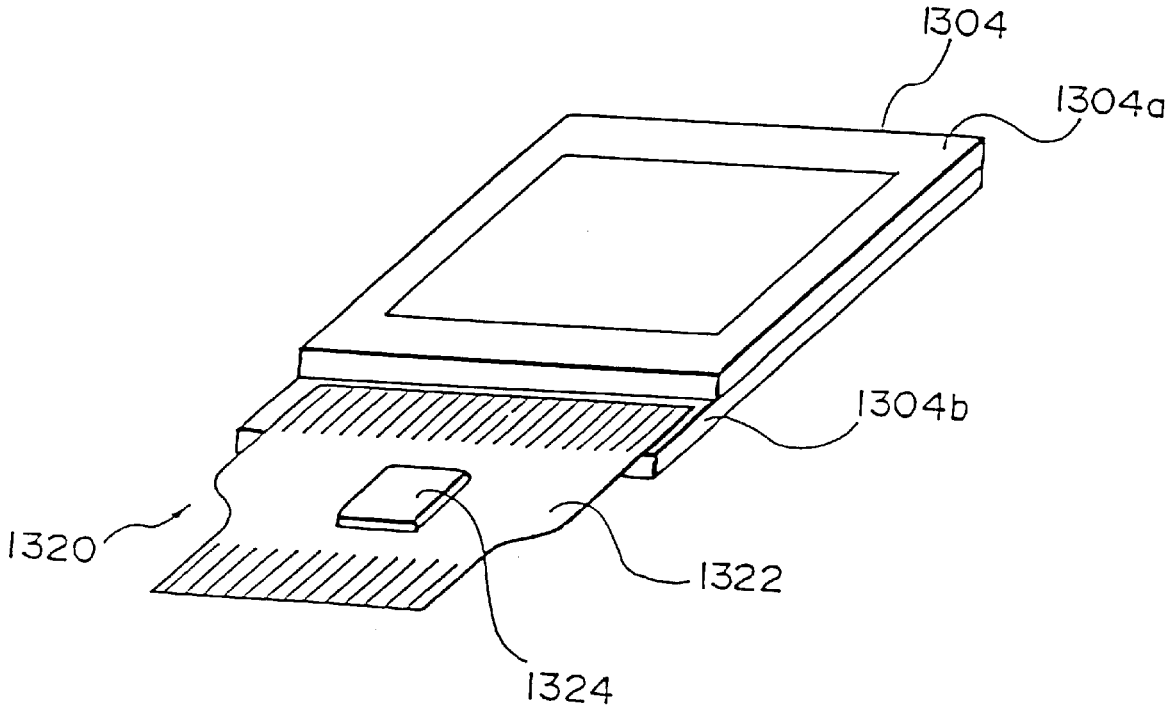
FIG. 22 is a view showing a configuration of a liquid crystal display apparatus serving as a component of an electronic gear.

In FIG. 21, which shows the configuration of the pager, the circuit board 1308 is required in addition to the liquid crystal display board 1304. When a liquid crystal display apparatus is used as a component of electronic gear and a display driving circuit, etc. is mounted on a transparent substrate, the minimum unit of the liquid crystal display apparatus is the liquid crystal display board 1304. Alternatively, the liquid crystal display board 1304 is secured to the metal frame 1302 serving as a casing and used as a liquid crystal display apparatus serving as a component of the electronic gear. In a backlight system, the liquid crystal display board 1304 and the light guide 1306 equipped with the backlight 1306*a* are assembled in the metal frame 1302 to form a liquid crystal display apparatus. Instead of these devices, as shown in FIG. 22, a TCP (tape carrier package) 1320 in which an IC chip 1324 is mounted on a polyimide tape 1322 having a metallic electrically conductive film is connected to one of two transparent substrates 1304*a* and 1304*b* constituting the liquid crystal display board 1304, and used as a liquid crystal display apparatus serving as a component of an electronic gear.

The present invention is not limited to the foregoing embodiments, but can be applied to various types of modifications within the scope of the invention. For example, the present invention can be applied to an electroluminescent apparatus and an plasma display apparatus in addition to the various liquid crystal panels described above.

INDUSTRIAL FIELD

As described above, since the liquid crystal display apparatus according to the present invention is provided with a data conversion circuit which converts n-bit digital input image data to (n+m)-bit data, and an (n+m)-bit digital data driver, images can be displayed with the desired gray-scale characteristics. Since a ROM in which a conversion table for compensating for the g characteristic of liquid crystal is written is used in the data conversion circuit, g correction can be achieved for all points in gray-scale display and thus superior gray-scale display performance is obtained. Since an (n+m)-bit D/A converter is built in, the number of externally input power sources is reduced and the apparatus can be made compact and lightweight at a lower cost. Because the liquid crystal display apparatus is of an active-matrix type using TFTs or nonlinear devices, a high contrast ratio is obtained and multiple-gray-scale display and full color display are enabled. Since peripheral drivers are integrated on a glass substrate with the use of poly-silicon TFT circuits, the apparatus can be made further compact and lightweight. Because a capacitor-coupling D/A converter is used, a low power consumption is achieved. Since capacitors having the same shape are disposed in parallel to form a D/A converter, the capacitor ratio is not varied and gray-scale display is enabled with high precision. Since a constant-current, binary attenuation-type D/A converter is used, even a vary large liquid crystal display apparatus can be implemented.

In a driving method for a liquid crystal display apparatus according to the present invention, since an n-bit digital input signal is sequentially converted to (n+m)-bit digital data according to the g characteristic of liquid crystal, accurate g correction is conducted with a simple circuit and thus a high-quality display image is obtained. Because an (n+m)-bit D/A-converted voltage is applied to each signal line after all signal lines are reset to the same voltage in the blanking period of a horizontal scanning period, the effect of a previously written signal can be eliminated and no after-image occurs.

Since a logic section is driven by a single low power source voltage lower than those for a D/A converter and a buffer section in the liquid crystal display apparatus according to the present invention, noise is unlikely to be generated on the screen. Since peripheral driving circuits are integrated with the use of poly-silicon TFTs, wiring for power sources can be used in common and thus has a lower resistance, noise is more unlikely to occur. Because a capacitor-division-type D/A converter is used, only the required minimum current flows and noise is more unlikely to be generated. Since a level shifter in which an input section is connected to n-channel and p-channel two transistors connected in parallel, the current flowing through the level shifter is suppressed and noise is further unlikely to be generated.

In the driving method for a liquid crystal display apparatus according to the present invention, since the power source voltage level of the D/A converter is switched alternately in every field, a low current is consumed and noise is unlikely to occur. Because non-inverted data is used in the capacitor-division-type D/A converter, an image-signal reversing circuit is not required, and a lower current is consumed and noise is reduced.

In the driving method for a liquid crystal display apparatus according to the present invention, since the power level is switched alternately in every field with the use of D/A converters in a plurality of systems, and reverse-polarity image signals are applied to adjacent signal lines, current consumption is low, and flicker or transverse crosstalk is not generated. Since non-inverted data is used in the capacitor-division-type D/A converter, an image-signal reversing circuit is not required, and a lower current is consumed and noise is reduced.

In the driving method for a liquid crystal display apparatus according to the present invention, since the power level is switched alternately in every horizontal scanning period with the use of D/A converters in a plurality of systems, and reverse-polarity image signals are applied to adjacent pixels at the left and right, and upper and lower positions, current consumption is low, and flicker or crosstalk in the horizontal and vertical directions is not generated. Since non-inverted data is used in the capacitor-division-type D/A converter, an image-signal reversing circuit is not required, and a lower current is consumed and noise is reduced.

In the driving method for a liquid crystal display apparatus according to the present invention, since the power source voltage level of the D/A converter is switched alternately in every field, and the common electrode voltage is also switched alternately in reverse polarities, the range of the power source voltage for the D/A converter can be reduced. Because non-inverted data is used in the capacitor-division-type D/A converter, an image-signal reversing circuit is not required, and a lower current is consumed and noise is reduced.

In the driving method for a liquid crystal display apparatus according to the present invention, since the power source voltage level of the D/A converter is switched alternately in every horizontal scanning period and the common electrode voltage is also switched alternately in reverse polarities, the range of the power source voltage for the D/A converter can be reduced. Flicker and longitudinal crosstalk are unlikely to occur. Because non-inverted data is used in the capacitor-division-type D/A converter, an image-signal reversing circuit is not required, and a lower current is consumed and noise is reduced.

In the driving method for a liquid crystal display apparatus according to the present invention, since the power source voltage level of the D/A converter is switched alternately in every field, and the scanning signal in the non-selection period is also switched alternately in reverse polarities, the range of the power source voltage for the D/A converter can be reduced. A low current is consumed and noise is unlikely to occur. Because non-inverted data is used in the capacitor-division-type D/A converter, an image-signal reversing circuit is not required, and a lower current is consumed and noise is reduced.

In the driving method for a liquid crystal display apparatus according to the present invention, since the power source voltage level of the D/A converter is switched alternately in every horizontal scanning period and the scanning signal in the non-selection period is also switched alternately in reverse polarities, the range of the power source voltage for the D/A converter can be reduced. A low current is consumed, noise is unlikely to occur, and longitudinal crosstalk is unlikely to be generated. Because non-inverted data is used in the capacitor-division-type D/A converter, an image-signal reversing circuit is not required, and a lower current is consumed and noise is reduced.

Since the liquid crystal display apparatus according to the present invention is provided with a circuit for delaying an image signal according to a delay time in the driver, when the driver is driven at a lower voltage, a shift does not occur on the display screen. Because the driver includes a delay-time detecting circuit and a delay-time compensation circuit, if driver manufacturing conditions vary or use conditions change, a shift does not occur on the display screen. Since peripheral drivers are integrated on a glass substrate with the use of poly-silicon TFT circuits, the apparatus is made compact and lightweight.

In the driving method for a liquid crystal display apparatus according to the present invention, since an image signal is delayed according to an estimated delay time in the driver, even if a driver circuit having a different performance is used in various conditions, a shift does not occur on the display screen. Because a delay time in the driver is detected and is self-compensated for in the delay-time compensation circuit, if driver manufacturing conditions vary or use conditions change, a shift does not occur on the display screen. Especially when the driver is formed by a TFT circuit, which has large variation, it can be driven by a simple external circuit.

Since an analog image signal is D/A-converted to an n-bit digital signal, data-converted in the g-correction circuit, and driven by an (n+m)-bit D/A converter in the display system according to the present invention, superior gray-scale display is allowed and full-color display is easily achieved. For example, a high-image-quality display system for multimedia can be readily implemented. Because the logic section has the same low signal amplitude, a display system which has a low power consumption and can be used for a long period even with a small battery is provided. Since an image signal is delayed according to a delay time in the driver, a shift does not occur on the screen even if the driver is driven at a low voltage. Therefore, power consumption can be further reduced and the system is unlikely to be susceptible to noise. Because a liquid crystal display apparatus in which peripheral drivers are integrated with the use of poly-silicon TFT circuits is used, the system is made compact and lightweight.

What is claimed is:

1. A liquid crystal display apparatus comprising:

a liquid crystal layer;

a plurality of scanning lines, the plurality of scanning lines being driven by a scanning driver having a first shift register and a first level shifter;

a plurality of signal lines, the plurality of signal lines being driven by a data driver having a second shift register, a second level shifter and a D/A converter;

pixels disposed correspondingly to the intersections of said scanning lines and said signal lines; and transistors for the pixels, the first shift register being connected to a common power source, and the second shift register being also connected to the common power source, signals having voltages between voltages of the common power source being used as logic signals, voltages of control signals for the D/A converter being increased by the second level shifter prior to D/A conversion, the second shift register in said data driver and the first shift register in said scanning driver connected to the common power source and logic signal inputs for the signal lines being powered by the common power source, and the voltage of said common power source being lower than the voltage of a power source for said D/A converter.

2. The liquid crystal display apparatus according to claim 1, the transistors for the pixels being thin-film transistors on a substrate, the data driver having a thin-film transistor formed on said substrate, and the scanning driver having a thin-film transistor formed on the substrate.

3. The liquid crystal display apparatus according to claim 1, the D/A converter including n capacitors having a capacitance ratio of 1:2:4: . . . :$2^{n-1}$ and n switches.

4. The liquid crystal display apparatus according to claim 1, wherein an input section of each of said level shifters is connected to n-channel and p-channel two transistors connected in parallel.

5. A driving method for a liquid crystal display apparatus, the liquid crystal display comprising:

a liquid crystal layer;

a plurality of scanning lines, the plurality of scanning lines being driven by a scanning driver having a first shift register and a first level shifter;

a plurality of signal lines, the plurality of signal lines being driven by a data driver having a second shift register, a second level shifter and a D/A converter;

pixels disposed correspondingly to the intersections of said scanning lines and said signal lines; and transistors for said pixels, said driving method further comprising:

inputting an image signal input to said D/A converter and a timing signal input to said second shift register having a same amplitude;

switching a power level of said D/A converter alternately in every field period to apply an AC voltage to said liquid crystal layer; and switching a first and second field period, in the first field period a voltage of a scanning signal being set at a higher voltage than a non-selection voltage before the voltage of the scanning signal changes from a selection voltage to the non-selection voltage after a selection period, and in the second field period the voltage of the scanning signal being set at a lower voltage than the non-selection voltage before the voltage of the scanning signal changes from the selection voltage to the non-selection voltage after the selection period, the second shift register in said data driver and the first shift register in said scanning driver being connected to a common power source, the image signal input to said D/A converter and the timing signal input to said second shift register being powered by the common power source, and the voltage of said common power source being lower than the voltage of a power source for said D/A converter.

6. A driving method for a liquid crystal display apparatus, the liquid crystal display comprising:

a liquid crystal layer;

a plurality of scanning lines, the plurality of scanning lines being driven by a scanning driver having a first shift register and a first level shifter;

a plurality of signal lines, the plurality of signal lines being driven by a data driver having a second shift register, a second level shifter and a D/A converter;

pixels disposed correspondingly to the intersections of said scanning lines and said signal lines; and transistors for the pixels, said driving method further comprising:

inputting an image signal input to said D/A converter and a timing signal input to said second shift register having a same amplitude; and switching a power level of said D/A converter alternately in every field period to apply an AC voltage to said liquid crystal layer, switching a first and a second horizontal scanning period, the first horizontal scanning period being followed by a period in which a voltage of a scanning signal is set at a higher voltage than a non-selection voltage, and the second horizontal scanning period being followed by a period in which the voltage of the scanning signal is set at a lower voltage than the non-selection voltage, the second shift register in said data driver and the first shift register in said scanning driver being connected to a common power source, the image signal input to said D/A converter and the timing signal input to said second shift register being powered by the common power source, and the voltage of said common power source being lower than the voltage of a power source for said D/A converter.

7. A driving method for a liquid crystal display apparatus, the liquid crystal display comprising:

a liquid crystal layer;

a plurality of scanning lines, the plurality of scanning lines being driven by a scanning driver having a first shift register and a first level shifter;

a plurality of signal lines, the plurality of signal lines being driven by a data driver having a second shift register, a second level shifter and a D/A converter;

pixels disposed correspondingly to the intersections of said scanning lines and said signal lines; and transistors for the pixels, said driving method further comprising:

inputting an image signal input to said D/A converter and a timing signal input to said second shift register having a same amplitude; and switching a power level of said D/A converter alternately in every field period to apply an AC voltage to said liquid crystal layer, a capacitor-coupling D/A converter being used as the D/A converter, and a digital signal that is not reversed for a black level and white level being used as the image signal input to the D/A converter, the second shift register in said data driver and the first shift register in said scanning driver being connected to a common power source, the image signal input to said D/A converter and the timing signal input to said second shift register being powered by the common power source, and the voltage of said common power source being lower than the voltage of a power source for said D/A converter.

8. A liquid crystal display apparatus comprising:

a first substrate, the first substrate comprising:

a plurality of scanning lines, a plurality of signal lines, pixel electrodes disposed correspondingly to the intersections of said scanning lines and said signal lines, and thin-film transistors for pixels, disposed correspondingly to said pixel electrodes;

a second substrate disposed opposite to said first substrate, the second substrate having a common electrode with the first substrate; and a liquid crystal layer held between said first substrate and said second substrate, wherein said signal lines are driven by a data driver having a shift register, a level shifter, and a D/A converter, and said scanning lines are driven by a scanning driver having a shift register, a level shifter, and a buffer, wherein said liquid crystal display apparatus includes the shift register in said data driver and the shift register in said scanning driver connected to a common $V_{dd}$ and $V_{ss}$, and a logic signal of a voltage between the $V_{dd}$ and $V_{ss}$ is input for the signal lines and is increased by the level shifter prior to D/A conversion, and wherein the voltage of said common power source is lower than the voltage of a power source for said D/A converter and said buffer.

9. A driving method for a liquid crystal display apparatus, the liquid crystal display apparatus including:

a first substrate, the first substrate including:

a plurality of scanning lines;

a plurality of signal lines, pixel electrodes disposed correspondingly to the intersections of said scanning lines and said signal lines, and transistors for pixels, disposed correspondingly to said pixel electrodes;

a second substrate disposed opposite to said first substrate, the second substrate having a common electrode with the first substrate; and a liquid crystal layer held between said first substrate and said second substrate, wherein said signal lines are driven by a data driver having a first shift register, a level shifter, and a D/A converter, and said scanning lines are driven by a scanning driver having a second shift register and a level shifter, said driving method comprising:

inputting an image signal input to said D/A converter and a timing signal input to said second shift register having a same amplitude;

switching a power level of said D/A converter alternately in every field period to apply an AC voltage to said liquid crystal layer; and switching a first and a second field period, a voltage scanning signal in the first field period being set at a higher voltage than a non-selection voltage before the voltage of the scanning signal changes from a selection voltage to the non-selection voltage after a selection period, and a voltage of the scanning signal in the second field period being set at a lower voltage than the non-selection voltage before a voltage of the scanning signal changes from the selection voltage to the non-selection voltage after the selection period, and in the both field periods a voltage of the common electrode of the second substrate being constant, the second shift register in said data driver and the first shift register in said scanning driver being connected to a common power source, the image signal input to said D/A converter and the timing signal input to said second shift register being powered by the common power source, and the voltage of said common power source being lower than the voltage of a power source for said D/A converter.

10. A driving method for a liquid crystal display apparatus, the liquid crystal display apparatus including:

a first substrate, the first substrate including:

a plurality of scanning lines, a plurality of signal lines, pixel electrodes disposed correspondingly to the intersections of said scanning lines and said signal lines, and transistors for pixels, disposed correspondingly to said pixel electrodes;

a second substrate disposed opposite to said first substrate, the second substrate having a common electrode with the first substrate; and a liquid crystal layer held between said first substrate and said second substrate, wherein said signal lines are driven by a data driver having a first shift register, a level shifter and a D/A converter, and said scanning lines are driven by a scanning driver having a second shift register and a level shifter, said driving method comprising:

inputting an image signal input to said D/A converter and a timing signal input to said second shift register having a same amplitude;

switching a power level of said D/A converter alternately in every field period to apply an AC voltage to said liquid crystal layer; and switching a first and a second horizontal scanning period, the first horizontal scanning period being followed by a period in which a voltage of a scanning signal is set at a higher voltage than a non-selection voltage, and the second horizontal scanning period being followed by a period in which the voltage of the scanning signal is set at a lower voltage than the non-selection voltage, and in the both horizontal scanning periods a voltage of the common electrode of the second substrate being constant, the second shift register in said data driver and the first shift register in said scanning driver being connected to a common power source, the image signal input to said D/A converter and the timing signal input to said second shift register being powered by the common power source, and the voltage of said common power source being lower than the voltage of a power source for said D/A converter.

* * * * *